US010167151B2

(12) United States Patent
Okamoto et al.

(10) Patent No.: US 10,167,151 B2
(45) Date of Patent: Jan. 1, 2019

(54) MEDIUM CONVEYANCE DEVICE AND MEDIUM TRANSACTION DEVICE

(71) Applicant: Oki Electric Industry Co., Ltd., Tokyo (JP)

(72) Inventors: Masaaki Okamoto, Tokyo (JP); Wataru Wakushima, Tokyo (JP); Kazuhiro Hosokawa, Tokyo (JP); Satoru Iwasaki, Tokyo (JP); Atsushi Takada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/570,740

(22) PCT Filed: May 19, 2016

(86) PCT No.: PCT/JP2016/064914

§ 371 (c)(1),
(2) Date: Oct. 30, 2017

(87) PCT Pub. No.: WO2016/190220

PCT Pub. Date: Dec. 1, 2016

(65) Prior Publication Data

US 2018/0170697 A1 Jun. 21, 2018

(30) Foreign Application Priority Data

May 26, 2015 (JP) ..... 2015-106705
Mar. 14, 2016 (JP) ..... 2016-050262

(51) Int. Cl.
*B65H 5/36* (2006.01)

(52) U.S. Cl.
CPC ..... *B65H 5/36* (2013.01); *B65H 2701/1912* (2013.01)

(58) Field of Classification Search
CPC ..... B65H 5/36; B65H 2701/1912; G07D 11/0021; G07D 11/0033; G07D 11/0081; G07D 11/0084
See application file for complete search history.

(56) References Cited

U.S. PATENT DOCUMENTS

2012/0211328 A1* 8/2012 Ito ..... G07D 11/0084 194/206
2012/0261874 A1* 10/2012 Arikata ..... G07D 11/0081 271/9.01

(Continued)

FOREIGN PATENT DOCUMENTS

JP 2013-242608 A 12/2013
WO WO-2012/056789 A1 5/2012
WO WO-2013/014704 A1 1/2013

*Primary Examiner* — David H Bollinger
(74) *Attorney, Agent, or Firm* — Rabin & Berdo, P.C.

(57) ABSTRACT

In a storage box guidance section provided to an upper portion of a banknote storage box in a banknote pay-in/pay-out device of an ATM, a groove is provided running along a front-rear direction at the right side of a storage box conveyance guide group. Further, in a handover section provided to a casing in the banknote pay-in/pay-out device, a position establishing section is provided to the right side of a handover section conveyance guide group. The left-right direction position of the storage box guidance section may accordingly be established with respect to the handover section by positioning the position establishing section inside the groove when storing a lower frame loaded with the banknote storage box and the like in the casing of the banknote pay-in/pay-out device. This enables finger sections of the storage box conveyance guide group and finger sections of the handover section conveyance guide group to be interlocked with each other without abutting.

12 Claims, 27 Drawing Sheets

(56) References Cited

U.S. PATENT DOCUMENTS

| | | | | |
|---|---|---|---|---|
| 2013/0307210 | A1 | 11/2013 | Takada | |
| 2014/0217669 | A1 | 8/2014 | Aoji et al. | |
| 2016/0325961 | A1* | 11/2016 | Kojima | B65H 31/34 |
| 2016/0335614 | A1* | 11/2016 | Norota | G07F 19/20 |

* cited by examiner

MEDIUM CONVEYANCE DEVICE AND MEDIUM TRANSACTION DEVICE

TECHNICAL FIELD

This application claims priority from Japanese Patent Application No. 2015-106705, filed on May 26, 2015, and Japanese Patent Application No. 2016-050262, filed on Mar. 14, 2016, the disclosures of which are incorporated by reference herein.

The present disclosure relates to a medium conveyance device and a medium transaction device, and is, for example, preferably applied to an Automatic Teller Machine (ATM) that is input with a medium such as banknotes by a customer and that performs desired transactions.

BACKGROUND ART

ATMs and the like, for example into which a customer pays in cash such as banknotes and coins, and that pay out cash to a customer according to the content of a transaction with the customer, are widely employed in financial institutions and the like.

An ATM has been proposed that includes, for example, a banknote pay-in/pay-out port that exchanges banknotes with a customer, a conveyance section that conveys banknotes along a conveyance path, a classification section that classifies the inserted banknotes by denomination and authenticity, a temporary holding section that temporarily holds inserted banknotes, and banknote storage boxes that store banknotes by denomination.

In such an ATM, during a pay-in transaction, when banknotes are inserted into the banknote pay-in/pay-out port by a customer, the inserted banknotes are conveyed by the conveyance section and classified by the classification section, and then banknotes classified as normal banknotes are stored in the temporary holding section, and banknotes classified as being unsuitable for transaction are placed back in the banknote pay-in/pay-out port and returned to the customer. The ATM then confirms the amount to be deposited by the customer, and then feeds out and conveys the banknotes stored in the temporary holding section such that the denominations thereof are classified once again by the classification section and the banknotes are stored in the respective banknote storage boxes according to their classified denominations.

In some ATMs, for example, a frame that is, for example, configured so as to be movable in a front-rear direction with respect to a casing using slide rails is formed with plural slots, and banknote storage boxes are attached and detached with respect to the respective slots in order to increase the efficiency of operations to replenish banknotes in the banknote storage boxes and operations to collect banknotes from the banknote storage boxes.

In such ATMs, there is a need for the frame to move smoothly in the front-rear direction with respect to the casing, and for banknotes to be handed over reliably between the conveyance section and the respective banknote storage boxes when the frame has been stored inside the casing. Specifically, smooth, step-free connection is required between guide faces of conveyance guides at the casing side and the banknote storage box side that cause banknotes to travel along the conveyance path, namely between surfaces facing the banknotes.

Some ATMs are provided with a finger section at leading ends of the conveyance guides on the casing side and on the banknote storage box side. Plural fingers are disposed at discrete locations along a guide face in each finger section, and the finger sections are interlocked with each other so as to connect guide faces together as smoothly as possible. However, in cases in which finger sections are interlocked in this manner, it is necessary to align their respective positions in at least the direction in which the fingers are arranged such that gaps between the fingers of one finger section allow the fingers of the other finger section to enter therebetween.

Therefore, ATMs have been proposed in which, for example, a positioning hole is formed in an upper face of a banknote storage box, and a positioning pin is provided on the casing side so as to be capable of moving in an vertical direction (see, for example, Japanese Patent Application Laid-Open (JP-A) No. 2013-242608). In such an ATM, when the frame is stored in the casing, the positioning pin is moved downward so as to fit into the positioning hole and bring the position of the banknote storage box into alignment, and when the frame is pulled out from the casing, the positioning pin is moved upward to permit movement of the banknote storage box.

SUMMARY OF INVENTION

Technical Problem

However, in ATMs configured in this manner, it is necessary to move the positioning pin in the vertical direction accompanying movement of the frame in the front-rear direction. This necessitates complex configurations made up of multiple components, such as link mechanisms, thereby leading to an increase in the number of components, resulting in increased manufacturing costs.

In consideration of the above circumstances, the present disclosure proposes a medium conveyance device and a medium transaction device in which the positions of guides that guide a medium are able to be precisely aligned with each other using a simple configuration.

Solution to Problem

A first aspect of the present disclosure is a medium conveyance device including a first casing; a second casing that is configured to move in an detachable direction so as to be disposed at a facing position facing the first casing, or so as to be disposed away from the facing position; a first conveyance guide that is provided to the first casing, and that is configured to guide a medium between the first casing and the second casing while the medium is conveyed along a conveyance direction intersecting the detachable direction when the second casing has been disposed at the facing position; a second conveyance guide that is provided to the second casing at a location facing the first conveyance guide when the second casing has been disposed at the facing position, and that is configured to guide the medium together with the first conveyance guide; a first finger section that is disposed at a location on the first conveyance guide facing the second conveyance guide, and that is provided with plural first fingers respectively projecting out toward the second conveyance guide at discrete locations along a width direction intersecting both the detachable direction and the conveyance direction; a second finger section that is disposed at a location on the second conveyance guide facing the first conveyance guide, and that is provided with plural second fingers respectively projecting out toward the first conveyance guide at discrete locations along the width direction that are complementary locations to the respective first fingers of the first finger section; a guiding side-face that is provided to one of the first casing or the second casing, and that is formed facing in the width direction and running along the detachable direction; and a position establishing section that is provided to the other of the first casing or the second casing, and that establishes a width direction position with respect to the guiding side-face such that the first finger section and the second finger section interlock with each other when the second casing has been disposed at the facing position.

A second aspect of the present disclosure is a medium transaction device including a first casing that is provided with a conveyance section to convey a medium for transaction with a user; a second casing that internally stores the medium, and that is configured to move in an detachable direction so as to be disposed at a facing position facing the first casing, or so as to be disposed away from the facing position; a first conveyance guide that is provided to the first casing, and that is configured to guide the medium between the first casing and the second casing as the medium is conveyed along a conveyance direction intersecting the detachable direction when the second casing has been disposed at the facing position; a second conveyance guide that is provided to the second casing at a location facing the first conveyance guide when the second casing has been disposed at the facing position, and that is configured to guide the medium together with the first conveyance guide; a first finger section that is disposed at a location on the first conveyance guide facing the second conveyance guide, and that is provided with plural first fingers respectively projecting out toward the second conveyance guide at discrete locations along a width direction intersecting both the detachable direction and the conveyance direction; a second finger section that is disposed at a location on the second conveyance guide facing the first conveyance guide, and that is provided with plural second fingers respectively projecting out toward the first conveyance guide at discrete locations along the width direction that are complementary locations to the respective first fingers of the first finger section; a guiding side-face that is provided to one of the first casing or the second casing, and that is formed facing in the width direction and running along the detachable direction; and a position establishing section that is provided to the other of the first casing or the second casing, and that establishes a width direction position with respect to the guiding side-face such that the first finger section and the second finger section interlock with each other when the second casing has been disposed at the facing position.

With regards to the position establishing section and the guiding side-face, when the second casing has been disposed at the facing position, the position of the guiding side-face is established by the position establishing section in a direction along the width direction in which the guiding side-face approaches the position establishing section. The position establishing section and the guiding side-face thereby enable the width direction positions of the respective second fingers of the second finger section to be appropriately set with respect to the respective first fingers of the first finger section, enabling the finger sections to be interlocked such that guide faces of the first conveyance guide and the second conveyance guide are smoothly connected together.

Effects of Invention

The present disclosure enables the realization of a medium conveyance device and a medium transaction device in which the positions of guides that guide a medium are able to be precisely aligned with a simple configuration.

DESCRIPTION OF EMBODIMENTS

Explanation follows regarding embodiments for implementing the disclosure (referred to below as exemplary embodiments), with reference to the drawings.

1. First Exemplary Embodiment

1-1. Configuration of ATM and Banknote Pay-In/Pay-Out Device

Figure 1:
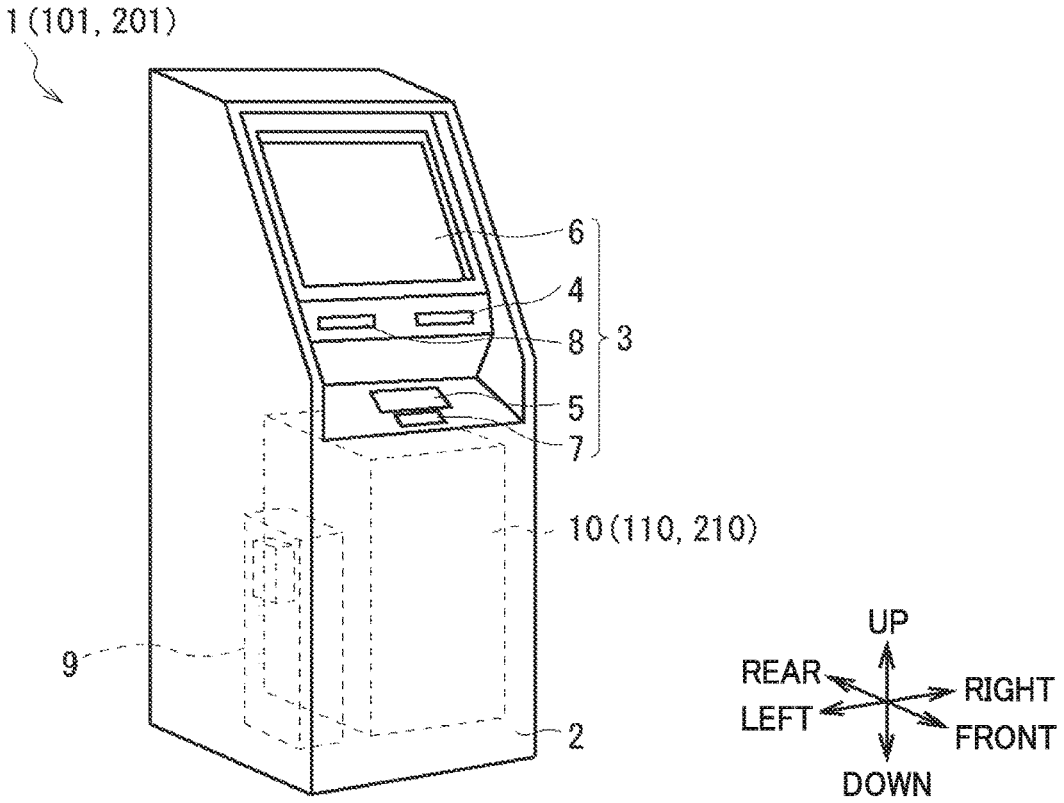
FIG. 1 is a schematic perspective view illustrating configuration of an ATM.

As illustrated in the external view of FIG. 1, an ATM 1 is mainly configured by a box shaped casing 2, and is installed, for example, in a financial institution to perform cash transactions such as pay-in transactions and pay-out transactions with a user (namely, a customer of the financial institution or the like).

The casing 2 is provided with a customer interface 3 at a location where a customer facing the front side of the casing 2 is able to easily insert banknotes, easily operate a touch panel, and the like. The customer interface 3 is provided with a card insertion/removal port 4, a pay-in/pay-out port 5, an operation and display section 6, a ten-key 7, and a receipt issue port 8. The customer interface 3 directly handles, for example, cash and passbook transactions with the customer, notifies transaction-related information, and receives operation instructions.

The card insertion/removal port 4 is a section for insertion and return of various cards, such as cash cards. A card processor (not illustrated in the drawings) that reads, for example, account numbers magnetically recorded on the various cards is provided inside the casing of the card insertion/removal port 4. The pay-in/pay-out port 5 is a section into which banknotes for paying in are inserted by a customer, and where banknotes for paying out to a customer are dispensed. The pay-in/pay-out port 5 is opened up, or closed off, by driving a shutter.

The operation and display section 6 is a touch panel integrating a liquid-crystal display (LCD) that displays operation screens during transactions, and a touch sensor that is input with, for example, a transaction type selection, a PIN, or a transaction amount. The ten-key 7 is a physical keypad that receives input of, for example, numbers 0 to 9. The ten-key 7 is used during PIN or transaction amount input operations and the like. The receipt issue port 8 is a section that issues a receipt printed with transaction details and the like at the end of transaction processing. A receipt processor (not illustrated in the drawings) that prints transaction details and the like on a receipt is provided behind the receipt issue port 8.

In the following explanation, the front side is established as the side of the ATM 1 that a customer faces, and the opposite side thereto is established as the rear side. The left side, right side, upper side and lower side are respectively established from the perspective of the left and right as seen by a customer facing the front side.

A main controller 9 that performs general control of the overall ATM 1, a banknote pay-in/pay-out device 10 that performs various processing relating to banknotes, and the like, are provided inside the casing 2. The main controller 9 is mainly configured by a central processing unit (CPU), not illustrated in the drawings. The main controller 9 reads and executes predetermined programs from read only memory (ROM), flash memory, or the like, not illustrated in the drawings, to perform various processing such as pay-in processing and pay-out processing. The main controller 9 includes an internal storage section configured by Random Access Memory (RAM), a hard disk drive, flash memory, or the like, which stores various information.

Figure 2:
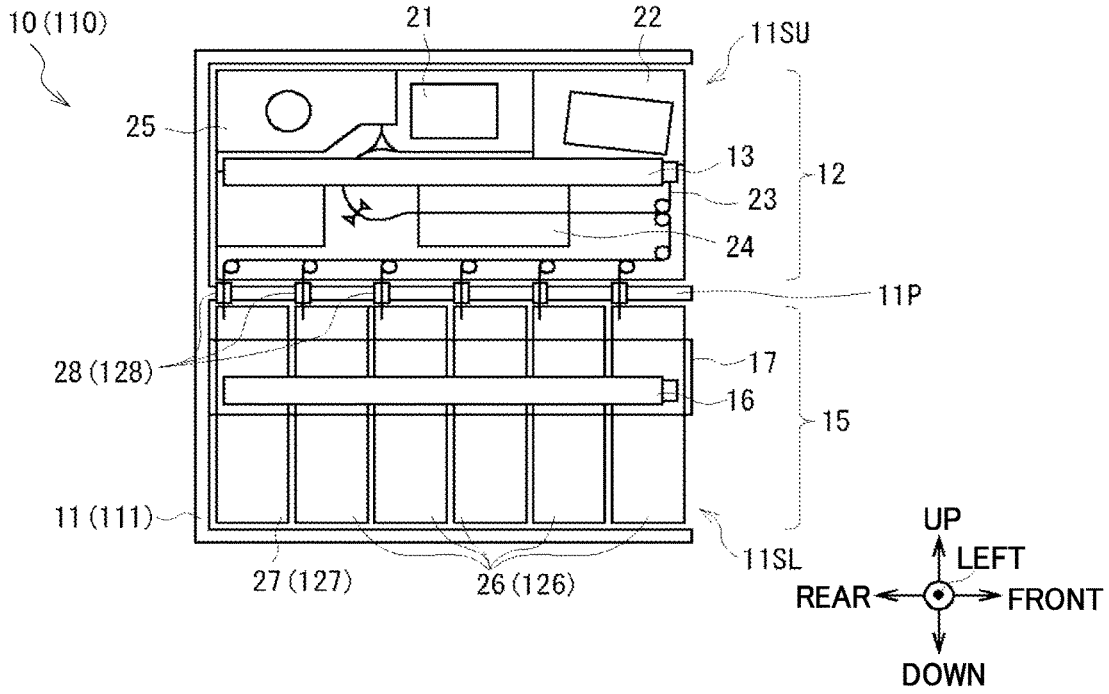
FIG. 2 is a schematic view illustrating configuration of a banknote pay-in/pay-out device.

As illustrated in side view in FIG. 2, the banknote pay-in/pay-out device 10 is incorporated, inside a casing 11 configured in a hollow cuboidal shape, with plural sections for performing various processing related to banknotes, serving as a medium. The front side of the casing 11 is open, the interior of the casing 11 is partitioned into an upper space 11SU at the upper side and a lower space 11SL at the lower side by a partitioning portion 11P provided at substantially the vertical direction central of the casing 11. The upper space 11SU and the lower space 11SL respectively house an upper unit 12 and a lower unit 15.

The upper unit 12 is provided with a banknote controller 21 that performs general control of the overall upper unit 12, a pay-in/pay-out section 22 that exchanges banknotes with a customer, a conveyance section 23 that conveys banknotes to the various sections, a classification section 24 that classifies banknotes, and a temporary holding section 25 that temporarily stores banknotes.

The banknote controller 21 is mainly configured by a CPU, not illustrated in the drawings, similarly to the main controller 9. The banknote controller 21 reads and executes predetermined programs from ROM, flash memory, or the like, not illustrated in the drawings, to perform various processing such as processing to determine the conveyance destination of banknotes and processing to control operation of the various sections. The banknote controller 21 includes an internal storage section configured by RAM, flash memory, or the like, which stores various information.

The pay-in/pay-out section 22 is positioned at an upper front portion inside the upper unit 12. The pay-in/pay-out section 22 separates banknotes received from a customer one note at a time and passes the banknotes to the conveyance section 23. The pay-in/pay-out section 22 also stacks banknotes conveyed from the conveyance section 23 and allows a user to take out the banknotes. Conveyance guides that guide banknotes, several rotating rollers, moving belts and the like are disposed as appropriate in the conveyance section 23, thereby forming a conveyance path (shown by solid lines in the drawings) for conveying banknotes. The conveyance section 23 conveys banknotes along the conveyance path by rotating each of the rollers as appropriate and moving each of the respective belts as appropriate. The conveyance section 23 positions the long edges of banknotes at a leading end side and at a rear end side in the traveling direction so as to convey the banknotes in a direction along their short edges.

The classification section 24 is disposed along the conveyance path of the banknotes. Plural types of sensors are incorporated inside the classification section 24 in order to identify the denomination, authenticity, condition (whether or not damage is present), and the like of the conveyed banknotes. Identification results are sent to the banknote controller 21. The temporary holding section 25 employs what is known as a tape escrow method, and stores banknotes by wrapping the banknotes against a circumferential side face of a circular cylinder shaped drum together with a tape, and feeds out the banknotes by peeling the tape away from the circumferential side face.

Plural banknote storage boxes 26 and a reject storage box 27 that store banknotes are provided in the lower unit 15. The banknote storage boxes 26 are all similarly configured, and each includes an internal space for stacking and storing banknotes. The banknote storage boxes 26 internally stack and store banknotes that have been determined by the classification section 24 and the banknote controller 21 to have a light degree of damage and to be suitable for re-use, and that have been conveyed by the conveyance section 23 according to their denomination. In response to receipt of an instruction from the banknote controller 21 to feed out banknotes, the banknote storage boxes 26 separate and feed out the stacked banknotes one note at a time, and pass the banknotes to the conveyance section 23.

The reject storage box 27 likewise includes an internal space for stacking and storing banknotes. The reject storage box 27 internally stores banknotes that have been determined by the classification section 24 and the banknote controller 21 to have a heavy degree of damage and to be unsuitable for re-use (referred to as reject banknotes), and that have been conveyed by the conveyance section 23.

Plural handover sections 28 are disposed along the front-rear direction between the upper unit 12 and the lower unit 15 in the casing 11. Each of the handover sections 28 includes a handover guide (described in detail later) for guiding banknotes. The handover sections 28 guide the passage of banknotes during handover of banknotes between the conveyance section 23 and the banknote storage boxes 26 or the reject storage box 27.

In cases in which, for example, a customer performs a pay-in transaction with the ATM 1, in coordination with the main controller 9 and the like, after receiving predetermined operation input from the operation and display section 6, the banknote controller 21 opens the shutter of the pay-in/pay-out port 5 (FIG. 1) to allow insertion of banknotes into the pay-in/pay-out section 22. After banknotes have been inserted, the pay-in/pay-out section 22 shuts the shutter of the pay-in/pay-out port 5, and then separates the banknotes one note at a time and passes the banknotes to the conveyance section 23. The conveyance section 23 conveys the received banknotes to the classification section 24 for classification, and the banknote controller 21 is notified of the obtained classification results. The banknote controller 21 decides the conveyance destination of each banknote accordingly.

When this is performed, the conveyance section 23 conveys banknotes classified by the classification section 24 as normal (referred to as normal notes) to the temporary holding section 25 where they are temporarily held. The conveyance section 23 conveys banknotes classified as unsuitable for transactions (referred to as damaged banknotes, counterfeit banknotes, or the like) to the pay-in/pay-out section 22 for returning to the customer.

The banknote controller 21 then prompts the customer to confirm the pay-in amount using the operation and display section 6 (FIG. 1), and conveys the banknotes held in the temporary holding section 25 to the classification section 24 where the banknotes are classified by denomination, degree of damage, and the like, and acquires the classification results. The banknote controller 21 then conveys banknotes with a heavy degree of damage to the reject storage box 27 via the respective handover section 28 so as to be stored as reject banknotes that are unsuitable for re-use. The banknote controller 21 also conveys banknotes with a light degree of damage to the banknote storage boxes 26 of the corresponding denominations via the respective handover section 28 so as to be stored as banknotes suitable for re-use.

On the other hand, in cases in which, for example, a customer performs a pay-out transaction with the ATM 1, in coordination with the main controller 9 and the like, after receiving predetermined operation input from the operation and display section 6 (FIG. 1), the banknote controller 21 feeds out banknotes from the banknote storage boxes 26 according to the amount to be paid out. The banknote controller 21 then passes the banknotes via the respective handover section 28 to the conveyance section 23, and uses the conveyance section 23 to convey the banknotes to the classification section 24 for classification, before conveying the banknotes to the pay-in/pay-out section 22 and opening the shutter of pay-in/pay-out port 5 (FIG. 1) to allow the customer to take out the banknotes.

The front side of the casing 2 of the ATM 1 is configured by a door that is able to be opened and closed. Opening the door enables access to the banknote pay-in/pay-out device 10 from the outside. The upper unit 12 and the lower unit 15 described above are respectively attached to the casing 11 of the banknote pay-in/pay-out device 10 through slide rails 13 and 16.

Figure 3A:
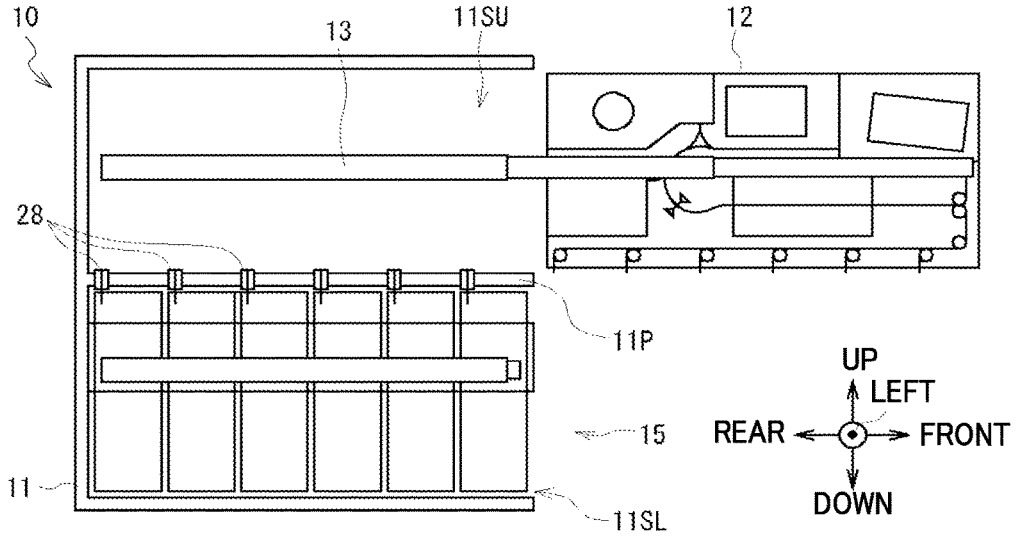
FIG. 3A is a schematic view illustrating sliding of an upper unit and a lower unit in the banknote pay-in/pay-out device.

Thus, in a state in which the door of the casing 2 has been opened, the banknote pay-in/pay-out device 10 is able to transition between a state in which the upper unit 12 is housed inside the upper space 11SU of the casing 11 as illustrated in FIG. 2, and a state in which the upper unit 12 is pulled out to the front side of the casing 11 as illustrated in FIG. 3A, by moving the upper unit 12 along the front-rear direction while causing the slide rails 13 to extend or retract.

Figure 3B:
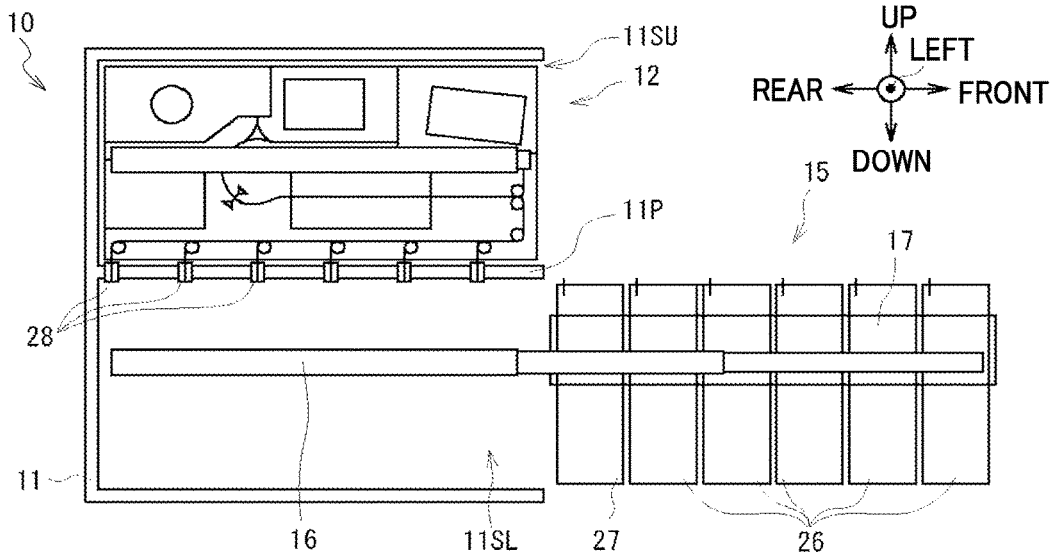
FIG. 3B is a schematic view illustrating sliding of the upper unit and the lower unit in the banknote pay-in/pay-out device.

Similarly, the banknote pay-in/pay-out device 10 is able to transition between a state in which the lower unit 15 is housed inside the lower space 11SL of the casing 11 as illustrated in FIG. 2, and a state in which the lower unit 15 is pulled out to the front side of the casing 11 as illustrated in FIG. 3B, by moving the lower unit 15 along the front-rear direction while causing the slide rails 16 to extend or retract.

Figure 4A:
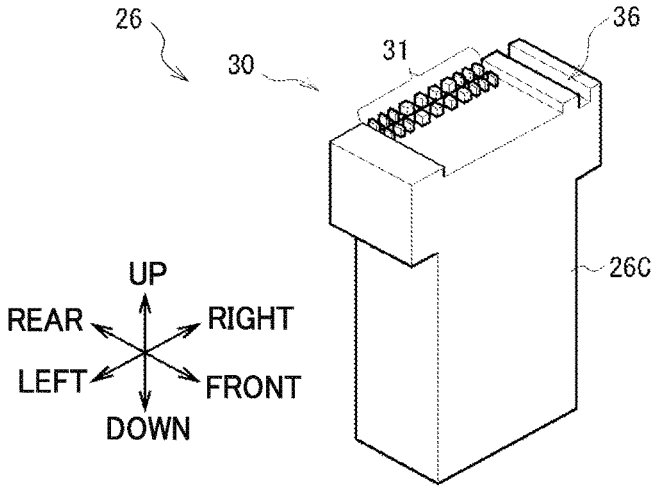
FIG. 4A is a schematic view illustrating configuration of the lower unit and a lower frame.
Figure 4B:
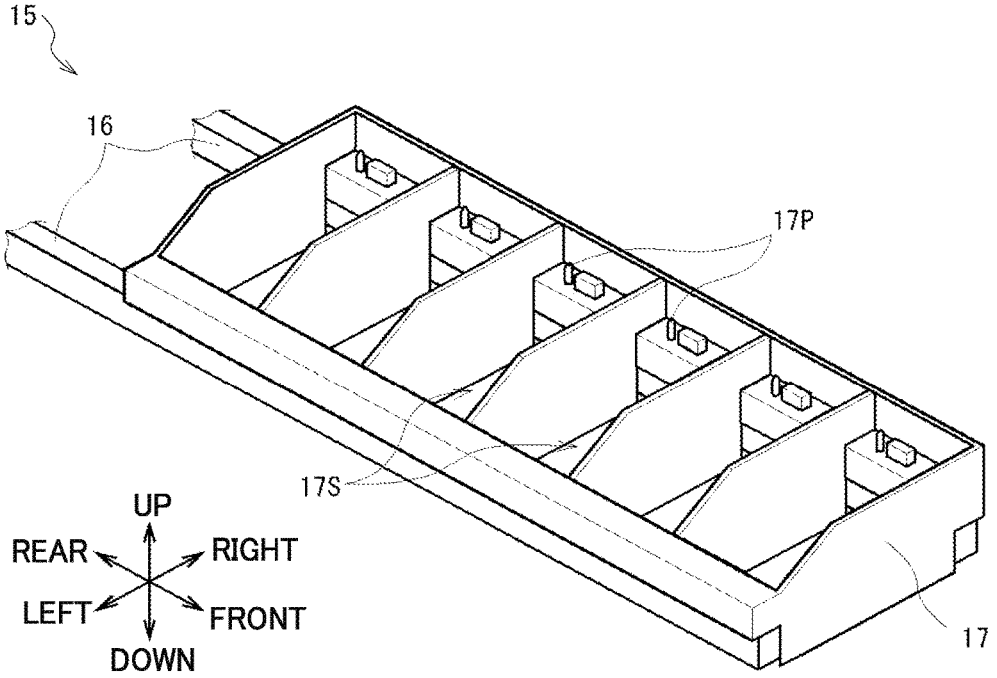
FIG. 4B is a schematic view illustrating configuration of the lower unit and the lower frame.

Further, in the lower unit 15, plural slots 17S are disposed in a row along the front-rear direction in a lower frame 17 attached to the slide rails 16 as illustrated in FIG. 4B. Each slot 17S is configured by a rectangular shaped hole penetrating in the vertical direction. A portion that supports a respective banknote storage box 26 or reject storage box 27 is formed at both the left and right sides of each slot 17S.

As illustrated in FIG. 4A, although formed overall in cuboidal shapes elongated in the vertical direction, the left-right direction length of an upper-side portion of each banknote storage box 26 extends beyond that of a respective lower-side portion such that the banknote storage boxes 26 are configured in letter T shapes as viewed along the front-rear direction. Note that the reject storage box 27 has the same exterior appearance as the banknote storage boxes 26.

Figure 4C:
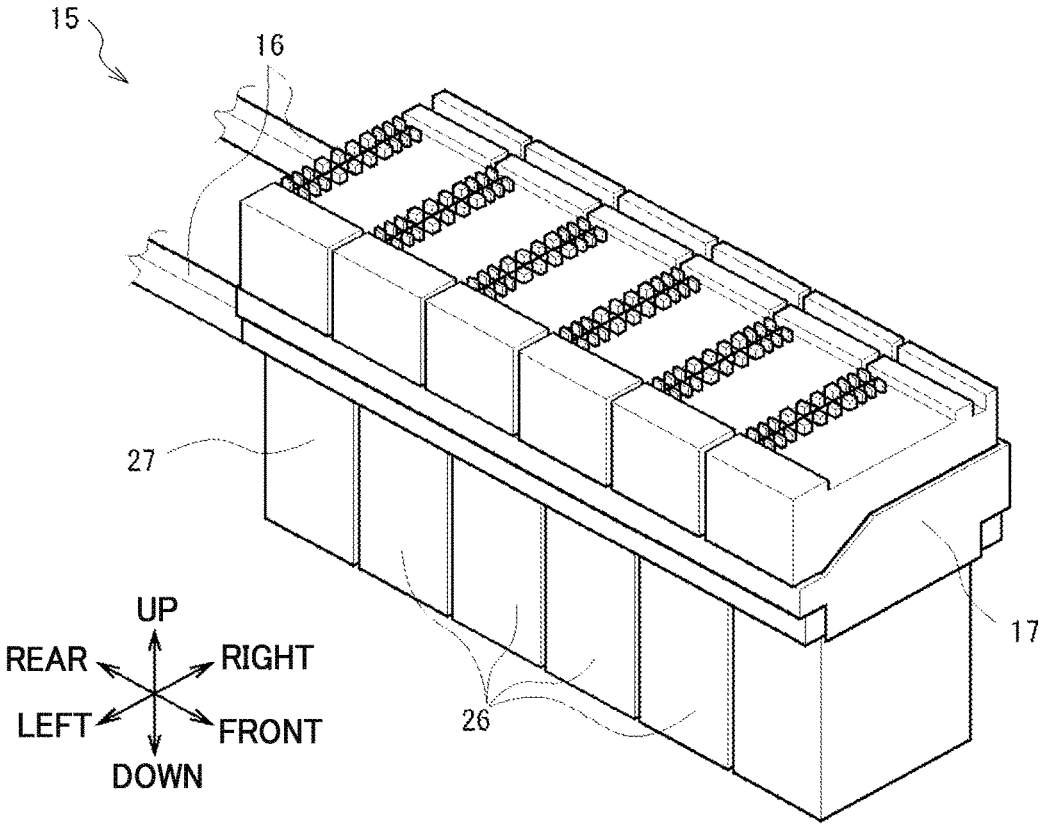
FIG. 4C is a schematic view illustrating configuration of the lower unit and the lower frame.

Thus, in the lower unit 15, the banknote storage boxes 26 are able to be loaded into the slots 17S as illustrated in FIG. 4C by lowering the banknote storage boxes 26 down from the upper side of the respective slots 17S in a state in which the lower frame 17 has been pulled out to the front of the casing 11.

Moreover, in the lower unit 15, the banknote storage boxes 26 may also be removed from the slots 17S by lifting the banknote storage boxes 26 up in a state in which the lower frame 17 loaded with the banknote storage boxes 26 has been pulled out to the front of the casing 11. In the lower unit 15, the reject storage box 27 is attached to/detached from a respective slot 17S of the lower frame 17 similarly to the banknote storage boxes 26. Hereafter, the front-rear direction, this being the direction along which the lower frame 17 moves with respect to the casing 11, is also referred to as a detachable direction.

Further, when the banknote storage boxes 26 have been loaded into the lower frame 17 and the lower frame 17 is stored inside the casing 11 (FIG. 2), upper faces of the banknote storage boxes 26 face the handover sections 28 provided at the partitioning portion 11P of the casing 11 such that the banknote storage boxes 26 are disposed at respective positions for performing handover of banknotes to and from the handover sections 28. Hereafter, the position of a banknote storage box 26 at which the upper face of the banknote storage box 26 faces a handover section 28 so as to enable the handover of banknotes therebetween is referred to as a facing position. Further, the vertical direction, this being the direction in which banknotes travel during banknote handover between the banknote storage boxes 26 and the handover sections 28, is also referred to as a conveyance direction.

In this manner, in the banknote pay-in/pay-out device 10, when the banknote storage boxes 26 have been respectively loaded into the slots 17S of the lower frame 17 and the lower frame 17 is stored inside the casing 11, each of the banknote storage boxes 26 is disposed at a respective facing position (FIG. 2) so as to enable banknote handover with the respective handover sections 28 of the casing 11 to be performed.

1-2. Configuration of Storage Box Guidance Section and Handover Section

Next, explanation follows regarding configuration of the banknote storage boxes 26 and the handover sections 28, as well as positioning of the conveyance guides respectively provided thereto.

1-2-1. Configuration of Storage Box Guidance Section

Figure 5:
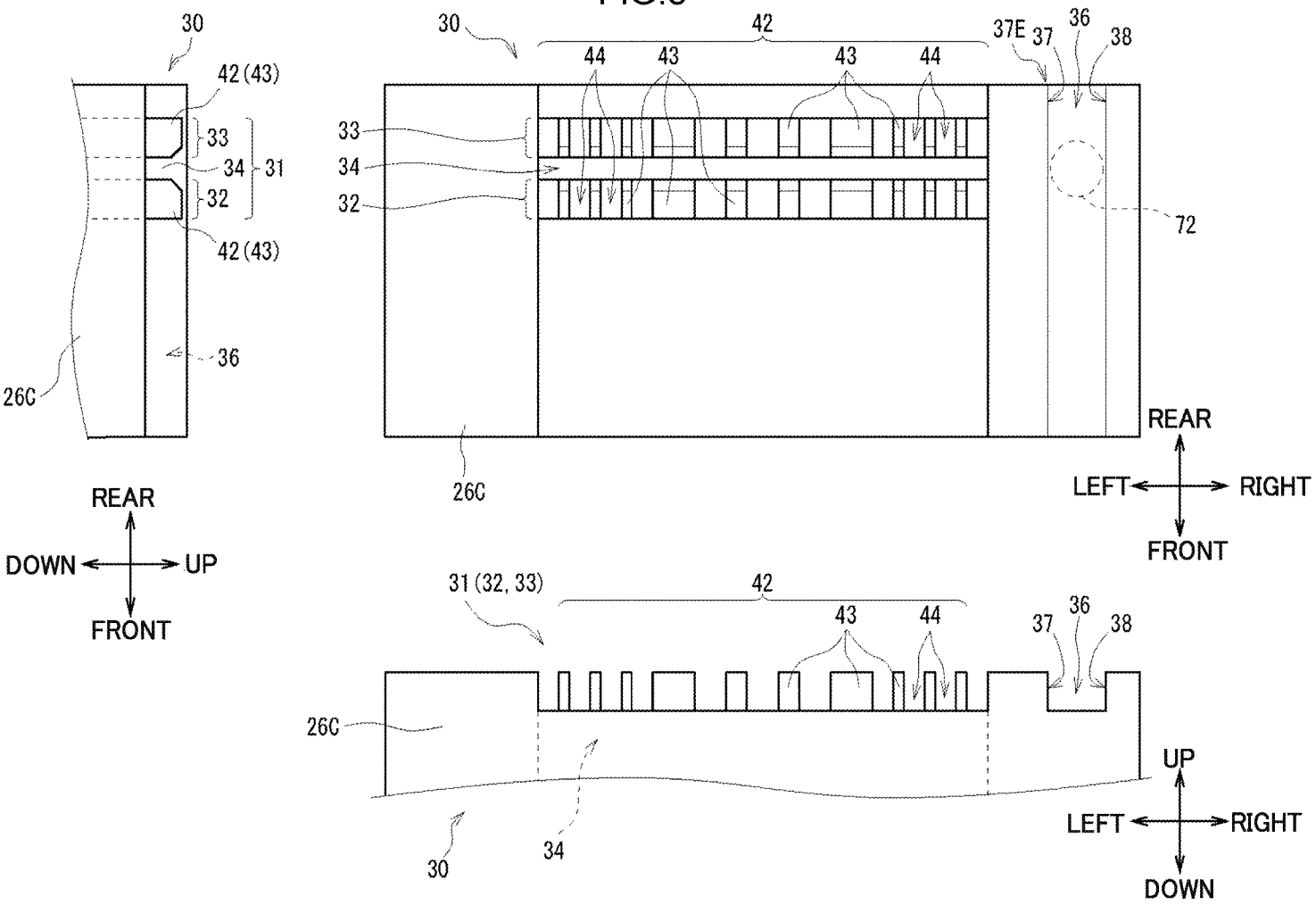
FIG. 5 is a schematic three-plane diagram illustrating configuration of a storage box guidance section.

As illustrated in the perspective view of FIG. 4A and the partial three-plane diagram of FIG. 5, a storage box guidance section 30 that guides banknotes conveyed to/from a respective handover section 28 is formed at an upper portion of a storage box casing 26C of each banknote storage box 26. The storage box guidance section 30 is provided with a front storage box conveyance guide 32 disposed at a front side and a rear storage box conveyance guide 33 disposed at a rear side.

A conveyance space 34, configured by a predetermined spacing (for example, 5 mm), is formed between the front storage box conveyance guide 32 and the rear storage box conveyance guide 33. The conveyance space 34 configures a conveyance path along which banknotes are conveyed along the vertical direction with sheet faces of the banknotes facing the front-rear direction. For ease of explanation, hereafter, the front storage box conveyance guide 32 and the rear storage box conveyance guide 33 are also collectively referred as a storage box conveyance guide group 31.

A finger section 42 is provided to the rear storage box conveyance guide 33 at an upper end of a main body thereof that is formed with a flat front face. Plural fingers 43 are disposed at discrete locations along the left-right direction in the finger section 42, namely so as to form gaps 44 of a predetermined spacing in the left-right direction. Plural types of the fingers 43, each with a different left-right direction length, are disposed in a predetermined sequence in the finger section 42.

The respective fingers 43, serving as second fingers, are formed in small, substantially cuboidal shapes. The positions of front faces and upper faces of the respective fingers 43 are aligned with each other. Moreover, the front faces of the respective fingers 43 are continuous to a front face of the main body. Furthermore, a front-upper-side portion of each finger 43 is configured with a shape cut away obliquely in the vicinity of a join portion between the front face and the upper face, thereby forming an inclined face facing in a direction obliquely upward toward the front.

For ease of explanation, hereafter, the left-right direction along which the plural fingers 43 are arranged is also referred to as the width direction. The width direction (left-right direction) is a direction intersecting both the detachable direction (front-rear direction) and the conveyance direction (vertical direction) described above.

The front storage box conveyance guide 32 is configured so as to be substantially front-rear symmetrical to the rear storage box conveyance guide 33, and a finger section 42 is formed at an upper end of the main body of the front storage box conveyance guide 32. Similarly to the rear storage box conveyance guide 33, plural of the fingers 43 are disposed at discrete locations along the left-right direction in the finger section 42. Gaps 44 are formed between adjacent fingers 43 in the left-right direction. Namely, in the front storage box conveyance guide 32 and the rear storage box conveyance guide 33, the positions and sizes of the respective fingers 43 are aligned with each other in the left-right direction and in the vertical direction. In the following explanation, a front face of the rear storage box conveyance guide 33 and a rear face of the front storage box conveyance guide 32 are also respectively referred to as guide faces.

Moreover, in the storage box guidance section 30 of the banknote storage box 26, a groove 36 is formed to the right side of the storage box conveyance guide group 31, namely at a position separated from the storage box conveyance guide group 31 in the width direction (left-right direction). The groove 36 is formed in a straight line shape running along the front-rear direction, and maintains a substantially uniform groove width (length L2) formed by a left guiding side-face 37 and a right guiding side-face 38 that are parallel to each other. The depth of the groove 36, namely the length from the upper face of each of the banknote storage boxes 26 to a bottom face of the groove 36, is slightly greater than the height of the fingers 43 of the rear storage box conveyance guide 33, or slightly greater than a gap portion formed between adjacent fingers 43.

Accordingly, in the storage box guidance section 30 of the banknote storage box 26, the finger sections 42 in which the fingers 43 are disposed at discrete locations along the left-right direction are formed at upper ends of the front storage box conveyance guide 32 and the rear storage box conveyance guide 33, and the groove 36 running in the front-rear direction is formed at the right side of the storage box conveyance guide group 31.

Similarly to in the banknote storage boxes 26, a storage box guidance section 30 is also formed at an upper portion of the reject storage box 27. Similarly to in the banknote storage boxes 26, the storage box guidance section 30 includes a storage box conveyance guide group 31 and is formed with a groove 36.

1-2-2. Configuration of Handover Section

Figure 6:
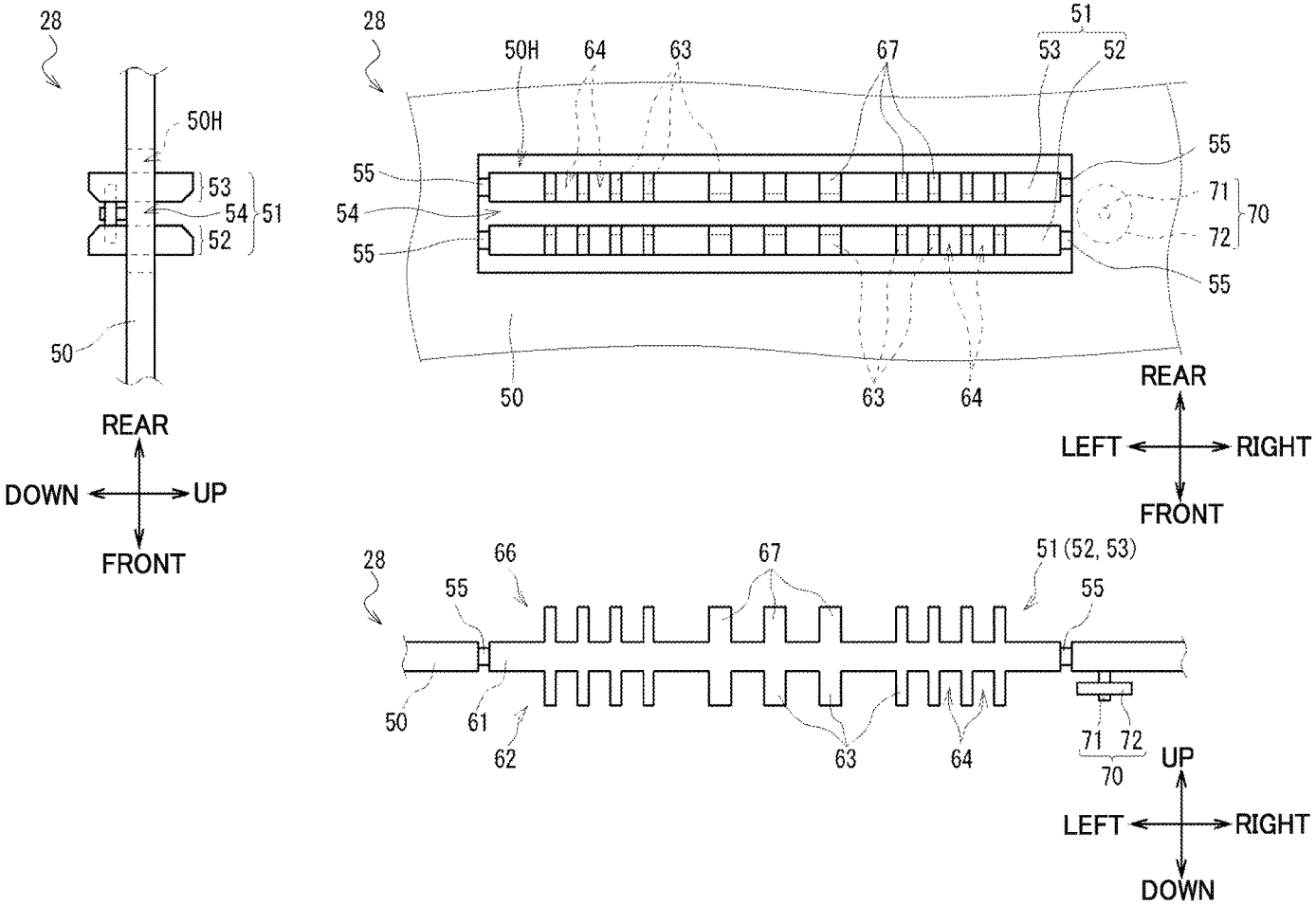
FIG. 6 is a schematic three-plane diagram illustrating configuration of a handover section.

As illustrated in the three-plane diagram of FIG. 6, the handover section 28 is mainly configured by a handover frame 50 formed by part of the partitioning portion 11P of the casing 11. The handover frame 50 is formed with a hole 50H that penetrates the handover frame 50 in the vertical direction and is an angular hole elongated in the left-right direction. A front handover section conveyance guide 52 and a rear handover section conveyance guide 53 are respectively provided at locations toward the front and toward the rear of the center of the hole 50H. For ease of explanation, hereafter, the front handover section conveyance guide 52 and the rear handover section conveyance guide 53 are also collectively referred to as a handover section conveyance guide group 51.

In the handover section 28, a conveyance space 54, configured by predetermined spacing (for example, 5 mm) is formed between the front handover section conveyance guide 52 and the rear handover section conveyance guide 53. Similarly to the conveyance space 34 of the banknote storage boxes 26, the conveyance space 54 configures a conveyance path along which banknotes are conveyed along the vertical direction with sheet faces of the banknotes facing the front-rear direction.

The rear handover section conveyance guide 53 is formed in a plate shape that, overall, is thin in the front-rear direction, comparatively short in the vertical direction, and long in the left-right direction. The rear handover section conveyance guide 53 is attached to the handover frame 50 through a rotation shaft 55 at both left and right ends. Accordingly, the rear handover section conveyance guide 53 is capable of swinging with respect to the handover frame 50 about the rotation shafts 55.

The rear handover section conveyance guide 53 is mainly configured by a cuboidal main body 61 that is thin in the front-rear direction, short in the vertical direction, and long in the left-right direction. A finger section 62 is formed at a lower end of the main body 61. Plural fingers 63 are disposed at discrete locations along the left-right direction in the finger section 62. Each finger 63 is formed in a small, substantially cuboidal shape, and front faces and lower faces of the respective fingers 63 have positions that are aligned with each other. Gaps 64 are formed between adjacent fingers 63 in the left-right direction.

The left-right direction positions and lengths of the respective fingers 63, serving as first fingers, are set so as to complement the respective fingers 43 of the rear storage box conveyance guide 33 of the banknote storage box 26. Namely, the left-right direction positions and lengths of the respective fingers 63 of the finger section 62 of the rear handover section conveyance guide 53 correspond to the respective finger-gaps 44 in the rear storage box conveyance guide 33. Moreover, the left-right direction positions and lengths of the respective gaps 64 in the rear handover section conveyance guide 53 correspond to the respective fingers 43 of the finger section 42 of the rear storage box conveyance guide 33.

The front handover section conveyance guide 52 is configured substantially front-rear symmetrical to the rear handover section conveyance guide 53, and a finger section 62 is formed at a lower end of the main body 61 of the front handover section conveyance guide 52. Similarly to in the rear handover section conveyance guide 53, in the finger section 62, plural fingers 63 are disposed at discrete locations along the left-right direction so as to have left-right direction positions and lengths that complement those of the respective fingers 43 of the front storage box conveyance guide 32 of the banknote storage box 26. Hereafter, a front face of the rear handover section conveyance guide 53 and a rear face of the front handover section conveyance guide 52 are also collectively referred to as guide faces.

A finger section 66 configured with symmetry in vertical direction to the finger section 62 is provided at an upper end of each of the main bodies 61 of the front handover section conveyance guide 52 and the rear handover section conveyance guide 53. Each finger section 66 is provided with plural fingers 67 configured with shapes having vertical symmetry with the respective fingers 63.

Moreover, a position establishing section 70 is provided at a right side of the handover section conveyance guide group 51 and at a lower face of the handover frame 50 of each handover section 28. The position establishing section 70 is configured by a support column 71 and a circular disk 72. The support column 71, serving as a rotation support body, has a thin circular column shape running along the vertical direction, and is provided projecting downward from a lower face of the handover frame 50. The vertical direction length of the support column 71 is equal to or less than the depth of the groove 36 in the banknote storage box 26.

The circular disk 72, serving as a circular disk body, is formed in a circular disk shape having a central axis running along the vertical direction, and has a thickness (namely an vertical direction length) that is sufficiently shorter than the support column 71. A length L1 representing the diameter of the circular disk 72 is shorter than a length L2, this being the groove width of the groove 36, by a difference value ΔL12. A circular hole is formed in the vicinity of the center of the circular disk 72. The circular hole has an internal diameter slightly greater than the external diameter of the support column 71, and penetrates the circular disk 72 in the vertical direction.

The support column 71 is inserted through the circular hole in the circular disk 72, and stoppers, not illustrated in the drawings, are attached above and below the circular disk 72 such that the support column 71 is capable of rotating with respect to the support column 71 without moving in the vertical direction. In other words, the circular disk 72 of the position establishing section 70 is configured similarly to a roller.

Note that as illustrated in FIG. 2, plural of the handover sections 28 are provided, at discrete locations along the front-rear direction, to the partitioning portion 11P that partitions the upper space 11SU and the lower space 11SL in the casing 11. Accordingly, plural position establishing section 70 are provided, at discrete locations along the front-rear direction, at a right side of a lower face of the partitioning portion 11P of the casing 11, namely, of a top face of the lower space 11SL.

Accordingly, each handover section 28 is formed with the respective finger sections 62, in which the fingers 63 are disposed at discrete locations along the left-right direction, at lower ends of the front handover section conveyance guide 52 and the rear handover section conveyance guide 53. Moreover, each handover section 28 is provided with the position establishing section 70 at a lower face of the handover frame 50 at a right side of the handover section conveyance guide group 51.

1-2-3. Positioning Between Conveyance Guides

As described above, in the banknote pay-in/pay-out device 10, the banknote storage boxes 26 and the reject storage box 27 are able to be disposed at their respective facing positions by loading the banknote storage boxes 26 and the reject storage box 27 into respective slots 17S in the lower frame 17 (FIG. 4B) and storing the lower frame 17 inside the casing 11.

When this is performed, firstly the banknote storage boxes 26 are positioned in the front-rear direction, the left-right direction, and the vertical direction with respect to the lower frame 17 by a positioning pin 17P (FIG. 4B) provided to each slot 17S of the lower frame 17 being inserted into a positioning hole (not illustrated in the drawings) provided to a lower face of a portion projecting toward the right side of the banknote storage box 26 (FIG. 4A). Accordingly, the banknote storage boxes 26 loaded into the respective slots 17S of the lower frame 17 adopt a state in which their vertical direction and left-right direction positions are aligned with each other, and the banknote storage boxes 26 form a row along the front-rear direction.

As described above, the storage box guidance sections 30 are respectively provided to the upper faces of the respective banknote storage boxes 26 and the reject storage box 27 loaded into the respective slots 17S of the lower frame 17. Accordingly, the grooves 36 respectively formed to each storage box guidance section 30 adopt a state arranged in a straight line along the front-rear direction according to the positions of each of the banknote storage boxes 26, thus forming a single, long groove along the front-rear direction (FIG. 4C).

As described above, in the casing 11, the plural position establishing sections 70 are provided at discrete locations along the front-rear direction at the right side of the lower face of the partitioning portion 11P. Accordingly, when the lower frame 17 is pushed toward the rear into the casing 11 from a state pulled out to the front of the casing 11 (FIG. 3B), the lower frame 17 moves almost directly toward the rear and parallel to the slide rails 16 accompanying an extension/retraction operation of the slide rails 16, and is stored inside the lower space 11SL.

Note that the length L1 representing the diameter of the circular disk 72 of each position establishing section 70 (FIG. 6) provided on the casing 11 side is slightly shorter than the length L2 representing the groove width of the grooves 36 of the storage box guidance sections 30 (FIG. 5) provided at the upper faces of the respective banknote storage boxes 26 and the reject storage box 27. Accordingly, the respective position establishing sections 70 sequentially enter the grooves 36 of the respective banknote storage boxes 26 and the reject storage box 27 accompanying the movement of the lower frame 17 toward the rear.

From another perspective, as a result of the respective position establishing sections 70 entering the grooves 36 of the respective banknote storage boxes 26 and the reject storage box 27, the left-right direction position of the storage box conveyance guide groups 31 with respect to the handover sections 28 is precisely established by the position establishing sections 70. When this occurs, although there is a possibility that the position establishing sections 70 may abut the left guiding side-face 37 and the right guiding side-face 38 of each groove 36, rotation of the circular disk 72 enables the position establishing sections 70 to travel smoothly without friction arising between the position establishing section 70 and the left guiding side-face 37 and the right guiding side-face 38.

Figure 7:
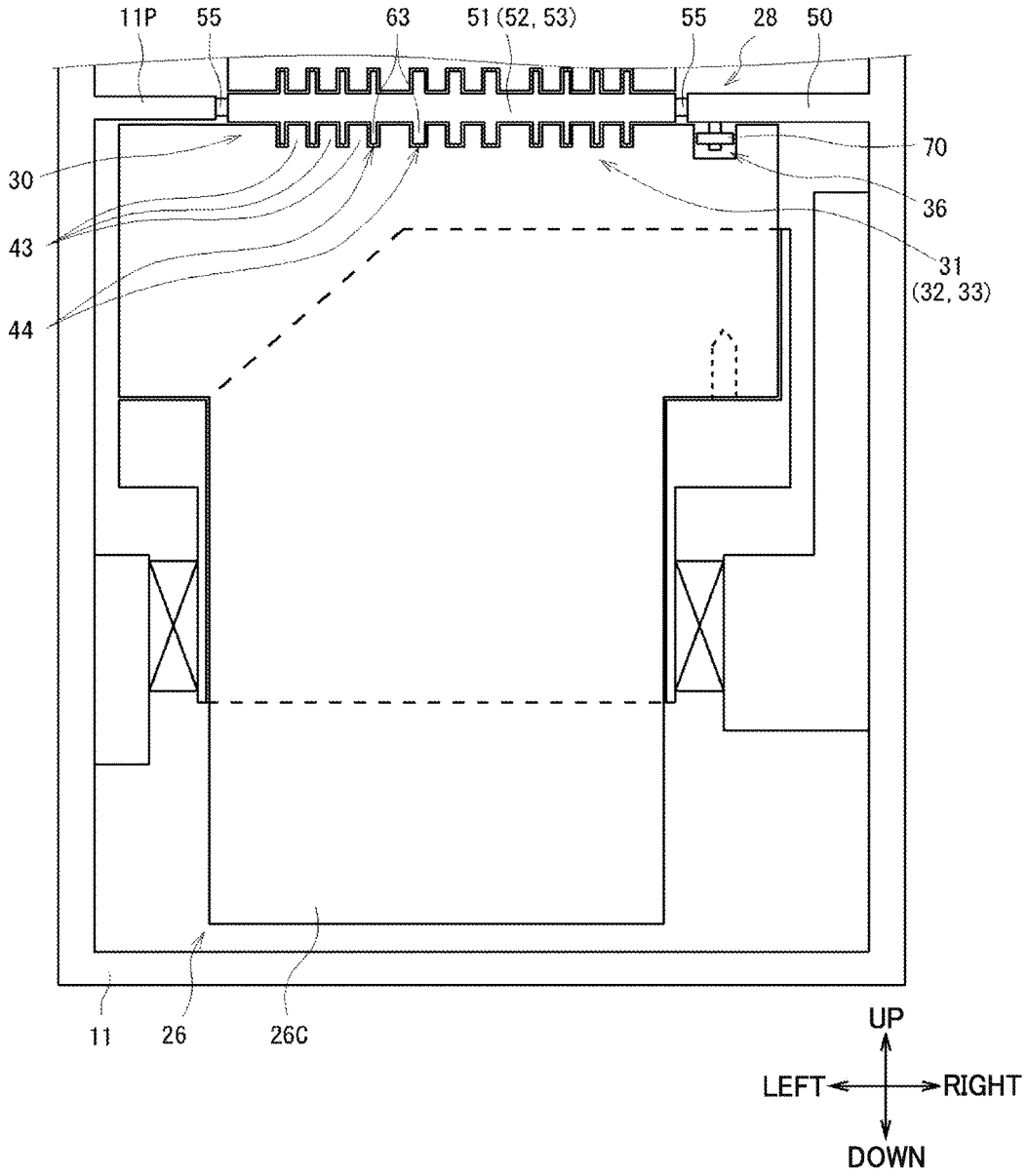
FIG. 7 is a schematic view illustrating configuration of a banknote storage box and a handover section, disposed at their facing positions, according to a first exemplary embodiment.

Thus, when the lower frame 17 is completely stored inside the lower space 11SL of the casing 11 (FIG. 2), the respective banknote storage boxes 26 and the reject storage box 27 reach their respective facing positions. When this occurs, the respective finger sections 42 of the front storage box conveyance guide 32 and the rear storage box conveyance guide 33 in the storage box guidance section 30 of each banknote storage box 26, and the respective finger sections 62 of the front handover section conveyance guide 52 and the rear handover section conveyance guide 53 of the handover section 28, interlock with each other as illustrated in FIG. 7. The front handover section conveyance guide 52 and the rear handover section conveyance guide 53 are adjusted in angle of inclination by swinging as appropriate about the respective rotation shafts 55.

Accordingly, the front face of the rear storage box conveyance guide 33 and the front face of the rear handover section conveyance guide 53 of each storage box guidance section 30 and handover section 28 are able to form an uninterrupted flat face or curved face that is connected smoothly along the vertical direction. Moreover, the rear face of the front storage box conveyance guide 32 and the rear face of the front handover section conveyance guide 52 of each storage box guidance section 30 and handover section 28 are able to form an uninterrupted flat face or curved face that is smoothly connected along the vertical direction.

As a result, guide faces of each banknote storage box 26 and handover section 28 may be smoothly connected together in the vertical direction at both the front and rear of the conveyance path for conveying banknotes between the banknote storage box 26 and the handover section 28, and are able to form flat faces or curved faces that are smoothly connected along the vertical direction. Each banknote storage box 26 and handover section 28 is thus able to move banknotes in the vertical direction along the conveyance path without the banknotes becoming jammed, namely is able to perform handover smoothly.

Figure 8:
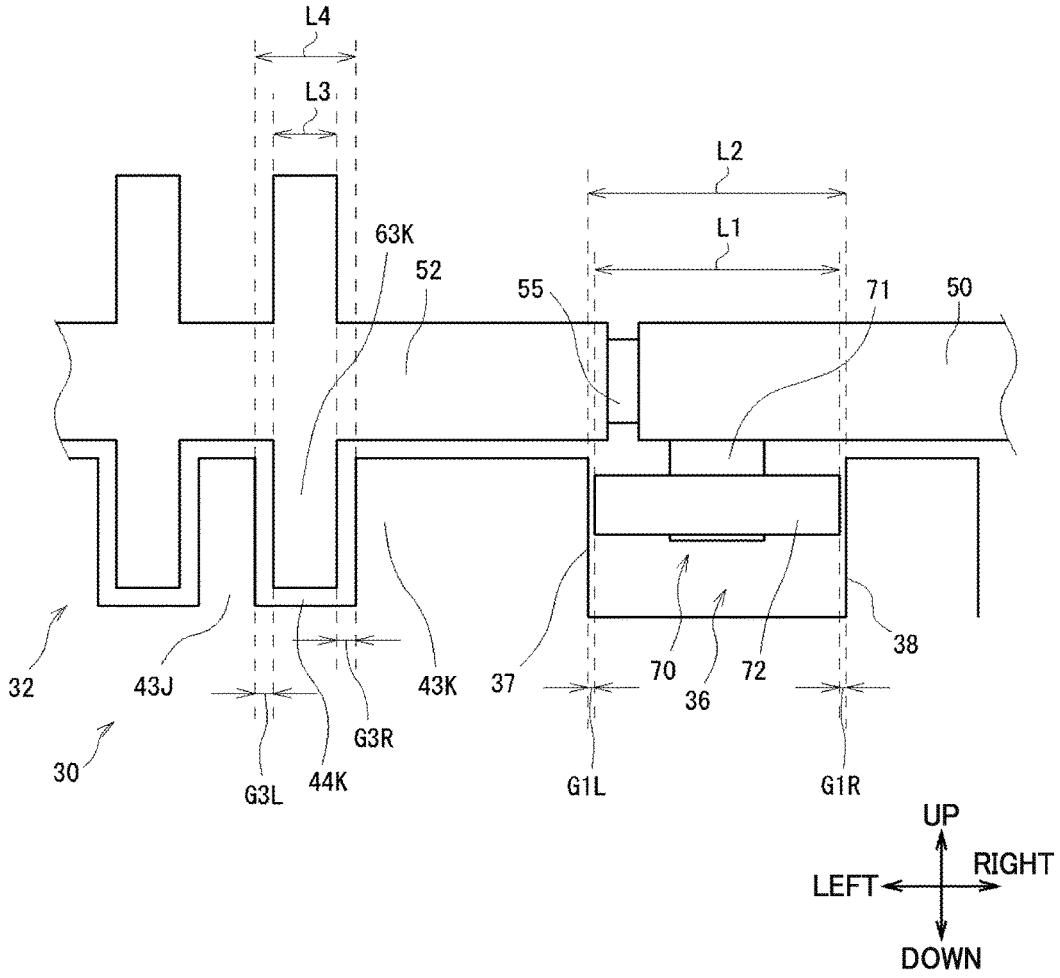
FIG. 8 is a schematic view illustrating interlocking finger sections as well as configuration of a groove and a position establishing section according to the first exemplary embodiment.

Explanation now focusses on a gap 44K formed between mutually adjacent fingers 43J and 43K in the finger section 42 of the rear storage box conveyance guide 33, and a finger 63K of the rear handover section conveyance guide 53 at a position corresponding to the gap 44K, as illustrated in FIG. 8, this being an enlargement of a portion of FIG. 7.

A length L4, this being the left-right direction spacing of the gap 44K, is longer than a length L3, this being the left-right direction length of the finger 63K. The finger 63K is thus able to enter the gap 44K as long as the banknote storage box 26 is correctly disposed at the facing position.

When this occurs, a left finger-gap G3L and a right finger-gap G3R are formed at the left and right sides of the finger 63K, these being gaps to the fingers 43J and 43K, respectively. The summed value of the left finger-gap G3L and the right finger-gap G3R will always be a difference value ΔL34, this being the difference between the length L4 and the length L3, due to the relationship between the finger 63K and the gap 44K. The respective values of the left finger-gap G3L and the right finger-gap G3R increase or decrease in a range from zero to the difference value ΔL34 depending on the left-right direction position of the rear storage box conveyance guide 33 relative to the rear handover section conveyance guide 53, namely depending on the position of the banknote storage box 26 relative to the casing 11 in the left-right direction.

Moreover, the length L1, this being the diameter of the circular disk 72 in the position establishing section 70, is shorter than the length L2, this being the groove width of the groove 36. Accordingly, when the position establishing section 70 has entered the groove 36, a left roller-gap G1L and a right roller-gap G1R are formed between the left and right sides of the position establishing section 70 and the left guiding side-face 37 and the right guiding side-face 38 of the groove 36, respectively.

The summed value of the left roller-gap G1L and the right roller-gap G1R will always be a difference value ΔL12, this being the difference between the length L2 and the length L1. The respective values of the left roller-gap G1L and the right roller-gap G1R increase or decrease in a range from zero to the difference value ΔL12 depending on the left-right direction position of the banknote storage box 26 relative to the casing 11.

In each storage box guidance section 30 and handover section 28, the length L1, this being the diameter of the circular disk 72, and the length L2, this being the groove width of the groove 36, are respectively set as appropriate such that the difference value ΔL12 is smaller than the difference value ΔL34. Moreover, in each storage box guidance section 30 and handover section 28, an attachment position of the position establishing section 70 and a formation position of the groove 36 are respectively set as appropriate such that the left roller-gap G1LL will always be smaller than the left finger-gap G3L, and such that the right roller-gap G1R will always be smaller than the right finger-gap G3R.

Accordingly, so long as the position establishing section 70 is in the groove 36, the value of either the left finger-gap G3L or the right finger-gap G3R will be a value greater than zero in each storage box guidance section 30 and handover section 28. This means that the finger section 42 of the rear storage box conveyance guide 33 and the finger section 62 of the rear handover section conveyance guide 53 interlock with each other, while always forming gaps and not abutting each other in the left-right direction. In other words, each storage box guidance section 30 and handover section 28 may be precisely positioned in the left-right direction between the finger section 42 of the rear storage box conveyance guide 33 and the finger section 62 of the rear handover section conveyance guide 53 by the position establishing section 70 and the groove 36.

The front storage box conveyance guide 32 and the front handover section conveyance guide 52 of each storage box guidance section 30 and handover section 28 are likewise able to interlock with each other such that the finger section 42 and the finger section 62 form gaps without abutting each other in the left-right direction.

1-3. Effects

In the banknote pay-in/pay-out device 10 of the ATM 1 according to the first exemplary embodiment configured as described above, the storage box guidance sections 30 are provided to the upper portions of the respective banknote storage boxes 26 and the reject storage box 27 loaded into the respective slots 17S of the lower frame 17, and the plural handover sections 28 are correspondingly provided to the partitioning portion 11P of the casing 11.

In each storage box guidance section 30, the finger sections 42 are respectively formed at the upper ends of the front storage box conveyance guide 32 and the rear storage box conveyance guide 33 positioned so as to surround the conveyance space 34 from the front and rear. The groove 36 is provided running along the front-rear direction at the right side of the finger sections 42 (FIG. 5). Moreover, in the handover section 28, the finger sections 62 are respectively formed at the lower ends of the front handover section conveyance guide 52 and the rear handover section conveyance guide 53 at positions surrounding the conveyance space 54 from the front and rear. The position establishing section 70 including the rotatable circular disk 72 is provided at the right side of the finger sections 62 (FIG. 6).

Accordingly, in the banknote pay-in/pay-out device 10, when the respective banknote storage boxes 26 and the reject storage box 27 have been loaded into the respective slots 17S of the lower frame 17, and the lower frame 17 has been stored in the lower space 11SL of the casing 11, the position establishing sections 70 are led into the grooves 36, and travel toward the rear in the grooves 36 (FIG. 7 and FIG. 8).

Note that the length L1, this being the diameter of the circular disk 72 of the position establishing section 70, is shorter than the length L2, this being the groove width of the groove 36, by the difference value ΔL12. Accordingly, in the banknote pay-in/pay-out device 10, the left-right direction position of the storage box guidance section 30 with respect to the handover section 28 may be appropriately established by positioning the circular disk 72 of the position establishing section 70 between the left guiding side-face 37 and the right guiding side-face 38 of the groove 36.

Moreover, in the banknote pay-in/pay-out device 10, the difference value ΔL12 between the position establishing section 70 and the groove 36 is smaller than the difference value ΔL34 between the length L4 of the finger-gaps 44 in the storage box conveyance guide group 31 and the length L3 of the finger 63 of the finger sections 62 in the handover section conveyance guide group 51. Furthermore, in the banknote pay-in/pay-out device 10, the attachment position of the position establishing section 70 and the formation position of the groove 36 are each determined as appropriate such that the left roller-gap G1L will always be smaller than the left finger-gap G3L, and such that the right roller-gap G1R will always be smaller than the right finger-gap G3R (FIG. 8).

Accordingly, in the banknote pay-in/pay-out device 10, the finger sections 42 of the storage box conveyance guide group 31 and the finger sections 62 of the handover section conveyance guide group 51 may be interlocked with each other, while always forming a gap and not abutting each other in the left-right direction. As a result, in the banknote pay-in/pay-out device 10, damage due to collisions between the finger sections 42 of the storage box conveyance guide group 31 and the finger sections 62 of the handover section conveyance guide group 51 may be reliably avoided when the banknote storage boxes 26 have moved in the front-rear direction together with the lower frame 17 and reached their facing positions.

Note that in the banknote pay-in/pay-out device 10, when the lower frame 17 swings in the left-right direction with respect to the casing 11 during front-rear direction movement of the lower frame 17, there is a possibility that the position establishing section 70 would abut and slide against the left guiding side-face 37 or the right guiding side-face 38 of the groove 36. Regarding this point, the circular disk 72 of the position establishing section 70 is configured capable of rotating with respect to the support column 71 running along the vertical direction (FIG. 6). Accordingly, in the banknote pay-in/pay-out device 10, the circular disk 72 is able to rotate when it abuts the left guiding side-face 37 or the right guiding side-face 38, and so the left guiding side-face 37 and the right guiding side-face 38 are not damaged as a result of sliding.

Figure 9A:
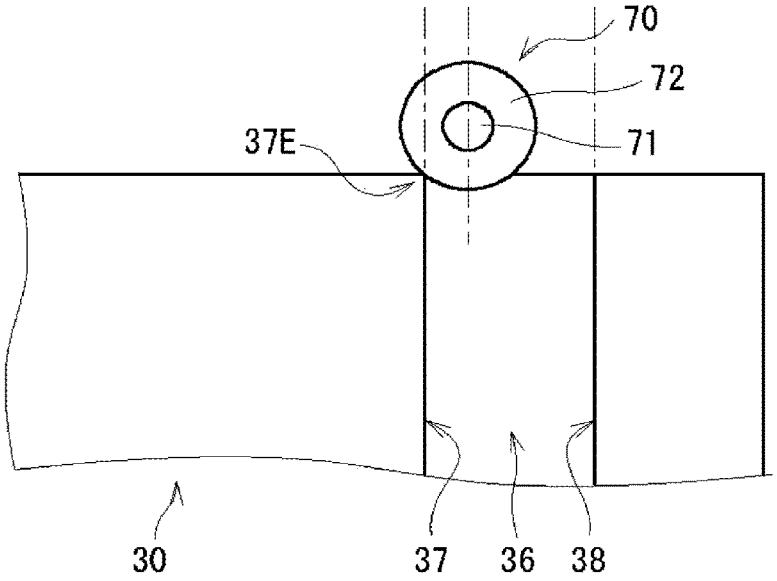
FIG. 9A is a schematic view illustrating positional correction of a storage box guidance section by a position establishing section.

Moreover, in the banknote pay-in/pay-out device 10, when storing the lower frame 17 in the lower space 11SL from the front side of the casing 11, the position establishing section 70 enters from the rear side of the groove 36 of the storage box guidance section 30 of the reject storage box 27, which is loaded furthest toward the rear side. Should the lower frame 17 swing in the left-right direction, for example, as illustrated in FIG. 9A, a portion of the position establishing section 70 may extend further to the left side than an extension line of the left guiding side-face 37 at the rear of the groove 36. Supposing the front face of the position establishing section 70 is flat, the front face would abut a portion peripheral to the rear end of the groove 36 of the storage box guidance section 30, obstructing movement toward the rear of the overall lower frame 17 containing the reject storage box 27.

Regarding this point, the circular disk 72 of the position establishing section 70 is formed in a circular disk shape, and is capable of rotating with respect to the support column 71 (FIG. 6). Accordingly, as illustrated in FIG. 9A, the circumferential face of the circular disk 72 of the position establishing section 70 is made to abut a rear end 37E of the left guiding side-face 37 so long as the central axis of the circular disk 72 is positioned within a range between an extension line from the left guiding side-face 37 and an extension line from the right guiding side-face 38.

Figure 9B:
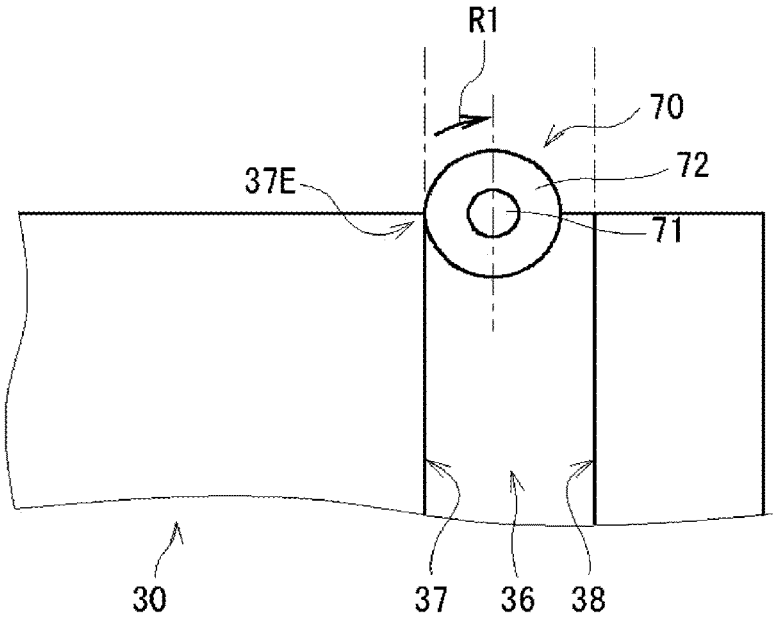
FIG. 9B is a schematic view illustrating positional correction of the storage box guidance section by the position establishing section.

In this state, when the lower frame 17 and the reject storage box 27 are pushed toward the rear, the circular disk 72 of the position establishing section 70 is rotated in the arrow R1 direction, as illustrated in FIG. 9B, thereby enabling the position establishing section 70 to enter the groove 36 while moving the entire reject storage box 27 slightly toward the left. Namely, the position establishing section 70 is able to correct the left-right direction position of the reject storage box 27 provided with the storage box guidance section 30 and the like, such that the storage box conveyance guide groups 31 and the handover section conveyance guide groups 51 approach the facing positions at which the they face each other.

Moreover, in each handover section 28, the position establishing section 70 is provided at the right side of the handover section conveyance guide group 51. The banknote pay-in/pay-out device 10 is thereby able to precisely align the positions of the finger sections 42 of the storage box conveyance guide group 31 and the finger sections 62 of the handover section conveyance guide group 51 at a location very close to where the left-right direction positions of the finger sections 42 of the storage box conveyance guide group 31 and the finger sections 62 of the handover section conveyance guide group 51 should be aligned.

Additionally, the position establishing section 70 may be configured by a small number of very simple components, such as the support column 71 and the circular disk 72. The groove 36 of the storage box guidance section 30 may likewise be easily formed without the addition of any components to the upper portions of the banknote storage boxes 26 and the like, such as by simply changing the shape of a portion of a mold used in injection molding. Accordingly, the banknote pay-in/pay-out device 10 is able to be configured very simply, enabling a reduction in the number of components and a reduction in the number of processing and assembly processes in comparison to cases adopting a complex structure in which a positioning pin is moved in the vertical direction, such as described in JP-A No. 2013-242608. This thereby enables a reduction in costs.

In the banknote pay-in/pay-out device 10, the groove 36 configured by a structure having a portion that is recessed with respect to its surroundings is formed on the side of the storage box guidance section 30 provided to upper portions of the banknote storage boxes 26 and the like. Moreover, the position establishing section 70 that projects further downward than its surroundings is provided on the handover section 28 side. Accordingly, in the banknote pay-in/pay-out device 10, even supposing a single banknote storage box 26 or the like collides with a foreign object when removed from the lower frame 17 and being carried, the likelihood of the groove 36 that is recessed with respect to its surroundings colliding with the foreign object is very low, such that there is virtually no concern of the groove 36 suffering deformation or damage.

Moreover, in the banknote pay-in/pay-out device 10, the plural handover sections 28 are provided at discrete locations along the front-rear direction on the partitioning portion 11P of the casing 11, and are disposed such that the vertical direction and left-right direction positions of the respective position establishing sections 70 are aligned with each other. Moreover, in the lower frame 17, the respective banknote storage boxes 26 and the like are loaded into the respective slots 17S that are formed in a row along the front-rear direction (FIG. 4B). Accordingly, the grooves 36 may be provided at the same positions as each other in the storage box guidance sections 30 of each of the banknote storage boxes 26 and the like. Namely, each of the banknote storage boxes 26 and the like is able to be configured with the same external profile regardless of its loading position in the lower frame 17, thereby enabling a reduction in manufacturing costs.

According to the above configuration, in the banknote pay-in/pay-out device 10 of the ATM 1 according to the first exemplary embodiment, the grooves 36 in the storage box guidance sections 30 provided to the upper portions of the banknote storage boxes 26 and the like are provided running along the front-rear direction at the right side of the storage box conveyance guide group 31. Moreover, the position establishing sections 70 in the handover sections 28 provided to the casing 11 in the banknote pay-in/pay-out device 10 are provided to the right side of the handover section conveyance guide group 51. This enables the left-right direction position of the storage box guidance sections 30 to be established with respect to the handover sections 28 by positioning the position establishing sections 70 inside the grooves 36 when storing the lower frame 17 loaded with the banknote storage boxes 26 and the like in the casing 11 of the banknote pay-in/pay-out device 10, thereby enabling the finger sections 42 of the storage box conveyance guide groups 31 and the finger sections 62 of the handover section conveyance guide groups 51 to be interlocked with each other without abutting.

2. Second Exemplary Embodiment

An ATM 101 (FIG. 1) of a second exemplary embodiment differs from the ATM 1 according to the first exemplary embodiment in the point that a banknote pay-in/pay-out device 110 is provided in place of the banknote pay-in/pay-out device 10, and is configured similarly in other respects. The banknote pay-in/pay-out device 110 (FIG. 2) differs from the banknote pay-in/pay-out device 10 in the point that a casing 111, banknote storage boxes 126, a reject storage box 127, and handover sections 128 are provided in place of the casing 11, the banknote storage boxes 26, the reject storage box 27, and the handover sections 28, and is configured similarly in other respects.

The banknote storage boxes 126 differ from the banknote storage boxes 26 in the point that in place of the storage box guidance section 30 they each include a storage box guidance section 130 at an upper portion of a storage box casing 126C provided in place of the storage box casing 26C, and are configured similarly in other respects. The reject storage box 127 likewise includes a storage box guidance section 130 similar to those of the banknote storage boxes 126.

Figure 10:
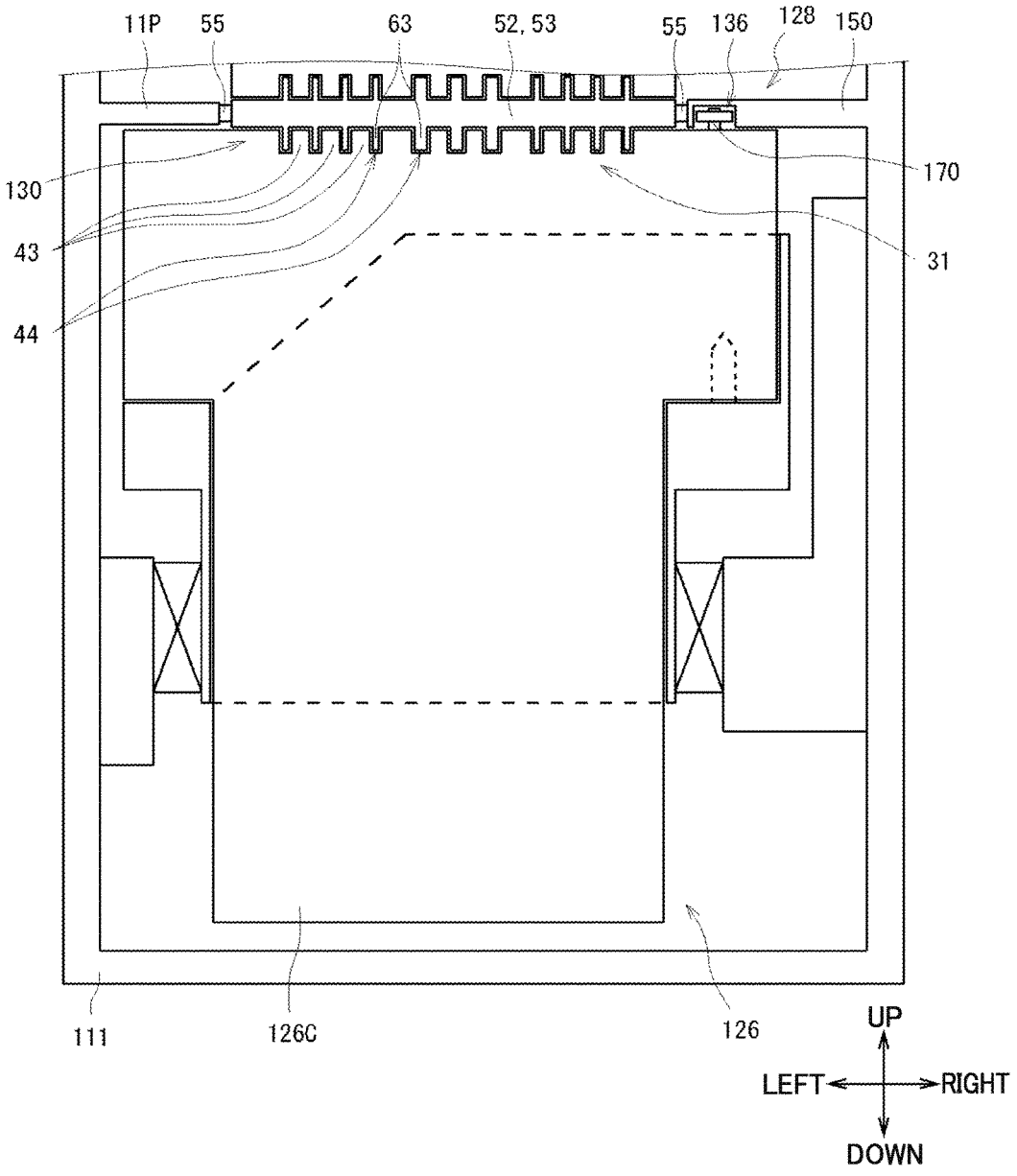
FIG. 10 is a schematic view illustrating configuration of a banknote storage box and a handover section, disposed at their facing positions, according to a second exemplary embodiment.
Figure 11:
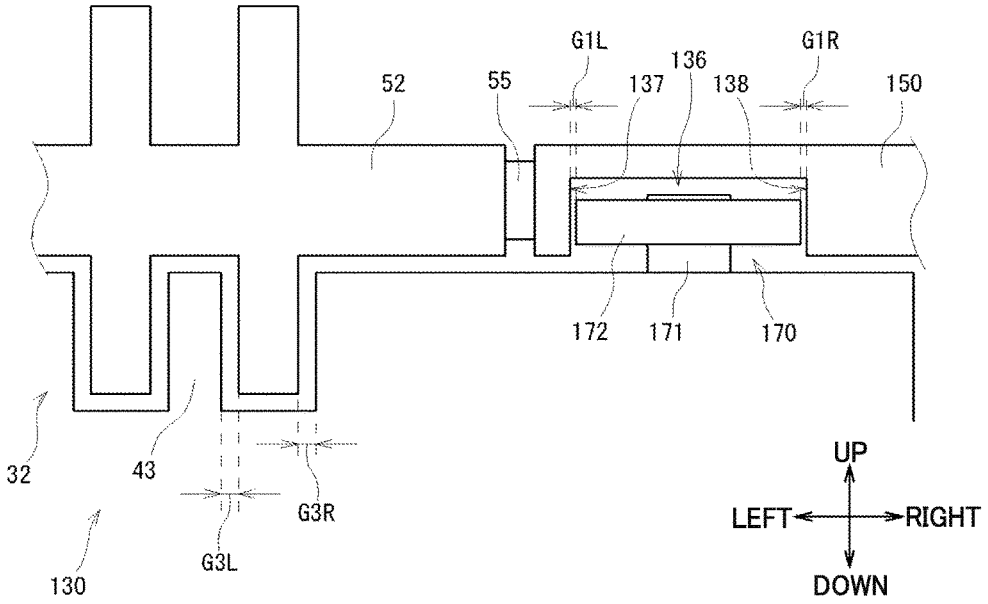
FIG. 11 is a schematic view illustrating interlocking finger sections as well as configuration of a groove and a position establishing section according to the second exemplary embodiment.

As illustrated in FIG. 10, which corresponds to FIG. 7, in place of the groove 36 at a right side of the storage box conveyance guide group 31, the storage box guidance section 130 is provided with a position establishing section 170 at the upper face of the banknote storage box 126 or the like. The position establishing section 170 is configured by inverting the position establishing section 70 of the first exemplary embodiment in the vertical direction, and projects further upward than the upper face of the storage box guidance section 130. The position establishing section 170 has a configuration similar to that of the position establishing section 70, such that a circular disk 172 is capable of rotating with respect to a support column 171 (FIG. 11).

On the other hand, the handover sections 128 are each provided with a groove 136 in place of the position establishing section 70 at the right side of the handover section conveyance guide group 51 of a handover frame 150 configuring part of the casing 111. The groove 136 is configured by inverting the groove 36 of the first exemplary embodiment in the vertical direction, and as illustrated in FIG. 11, which corresponds to FIG. 8, the groove 136 includes a left guiding side-face 137 and a right guiding side-face 138.

Similarly to in the banknote pay-in/pay-out device 10, in the banknote pay-in/pay-out device 110, an attachment position of the position establishing section 170 and a formation position of the groove 136 are each determined as appropriate such that a left roller-gap G1L will always be smaller than a left finger-gap G3L, and such that a right roller-gap G1R will always be smaller than a right finger-gap G3R.

Similarly to in the first exemplary embodiment, in the banknote pay-in/pay-out device 110 configured in this manner, the left-right direction position of the banknote storage box 126 or the like may be established with respect to the handover section 128 by the combination of the groove 136 of the handover sections 128 and the position establishing section 170 of the storage box guidance section 130 of the banknote storage box 126 or the like. Accordingly, in the banknote pay-in/pay-out device 110, similarly to in the first exemplary embodiment, the finger sections 42 of the storage box conveyance guide group 31 and the finger sections 62 of the handover section conveyance guide group 51 may be interlocked with each other without abutting in the left-right direction, while always forming gaps between each other so as to prevent damage due to collisions.

In other respects, the banknote pay-in/pay-out device 110 according to the second exemplary embodiment is able to exhibit similar operation and effects to those of the first exemplary embodiment.

According to the above configuration, the banknote pay-in/pay-out device 110 of the ATM 101 according to the second exemplary embodiment is provided with the position establishing section 170 at the right side of the storage box conveyance guide group 31 in the storage box guidance section 130 provided to the upper portion of each banknote storage box 126 or the like. Moreover, the banknote pay-in/pay-out device 110 is provided with the groove 136 running along the front-rear direction at the right side of the handover section conveyance guide group 51 in each of the handover sections 128 provided to the casing 111. Accordingly, in the banknote pay-in/pay-out device 110, the left-right direction position of the storage box guidance sections 130 may be established with respect to the handover sections 128 by positioning the position establishing section 170 inside the groove 136 when storing the lower frame 17 loaded with the banknote storage boxes 126 and the like in the casing 111. This enables the finger sections 42 of the storage box conveyance guide group 31 and the finger sections 62 of the handover section conveyance guide group 51 to be interlocked with each other without abutting.

3. Third Exemplary Embodiment

An ATM 201 (FIG. 1) according to a third exemplary embodiment differs from the ATM 1 according to the first exemplary embodiment in the point that a banknote pay-in/pay-out device 210 is provided in place of the banknote pay-in/pay-out device 10, and is configured similarly in other respects.

3-1. Configuration of Banknote Pay-In/Pay-Out Device

Figure 12A:
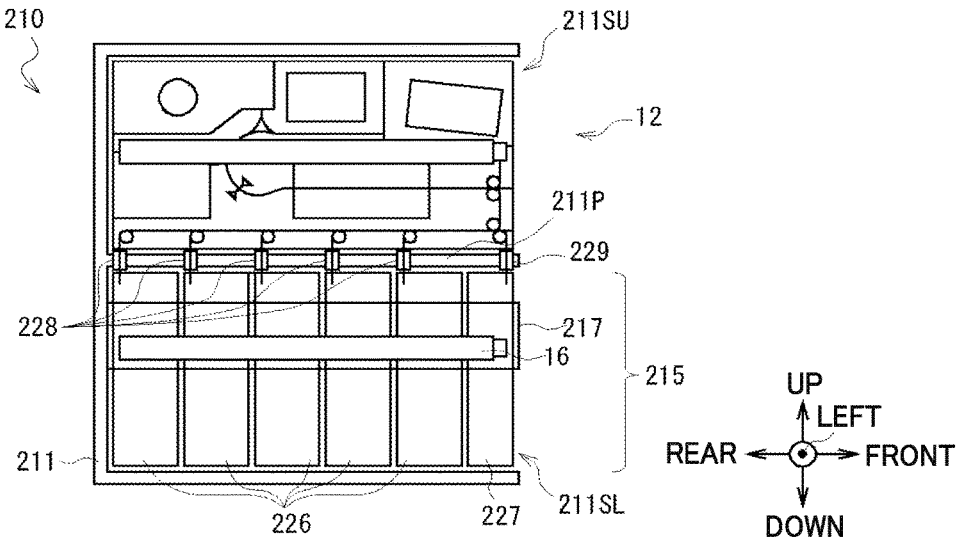
FIG. 12A is a schematic view illustrating configuration of a banknote pay-in/pay-out device according to a third exemplary embodiment.

As illustrated in FIG. 12A, which corresponds to FIG. 2, the banknote pay-in/pay-out device 210 differs from the banknote pay-in/pay-out device 10 in the point that a casing 211, banknote storage boxes 226, a reject storage box 227, and handover sections 228 and a handover section 229 are provided in place of the casing 11, the banknote storage boxes 26, the reject storage box 27, and the handover sections 28, and is configured similarly in other respects.

Similarly to in the first exemplary embodiment, the front side of the casing 211 is open, and a partitioning portion 211P provided at substantially the vertical direction center of the casing 211 partitions the interior of the casing 211 into an upper space 211SU on the upper side and a lower space 211SL on the lower side. The upper space 211SU and the lower space 211SL respectively house an upper unit 12 and a lower unit 215. The upper unit 12 has substantially the same configuration as in the first exemplary embodiment.

The lower unit 215 is provided with five banknote storage boxes 226, and a single reject storage box 227 positioned at the front side of the banknote storage boxes 226. Corresponding to these, five handover sections 228 and a single handover section 229 at the front side of the five handover sections 228 are disposed along the front-rear direction in the partitioning portion 211P of the casing 211. Similarly to the handover section 28 according to the first exemplary embodiment, the handover sections 228 and 229 each includes a handover guide (described in detail later) to guide banknotes. The handover sections 228 and 229 each guide the passage of banknotes between the conveyance section 23 and a banknote storage box 226 or the reject storage box 227 when a banknote is being handed over between the two sections.

Figure 12B:
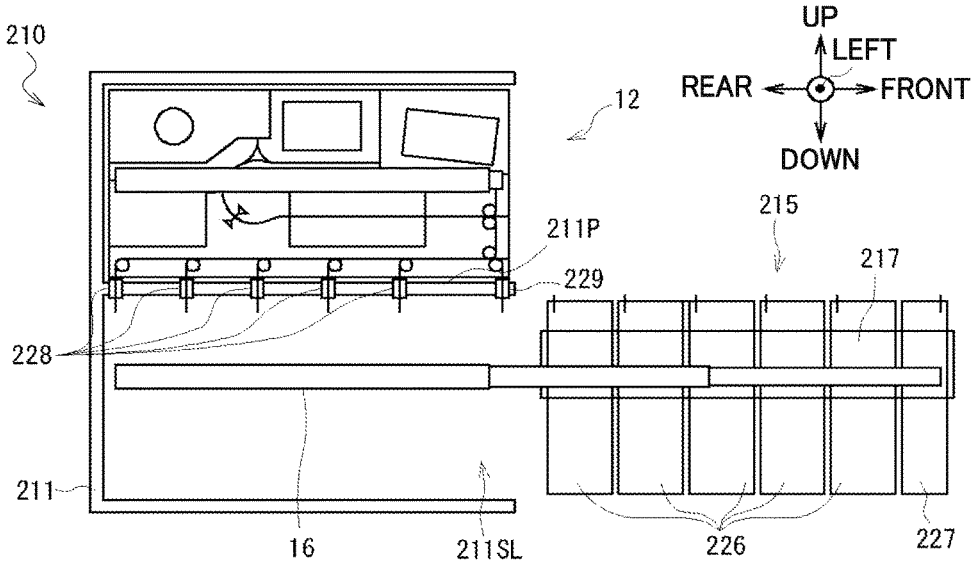
FIG. 12B is a schematic view illustrating configuration of the banknote pay-in/pay-out device according to the third exemplary embodiment.

The lower unit 215 is attached to the casing 211 through the slide rails 16. Thus, similarly to in the first exemplary embodiment, the banknote pay-in/pay-out device 210 is able to transition between a state in which the lower unit 215 is stored inside the lower space 211SL of the casing 211 as illustrated in FIG. 12A, and a state in which the lower unit 215 is pulled out to the front side of the casing 211 as illustrated in FIG. 12B.

Figure 13A:
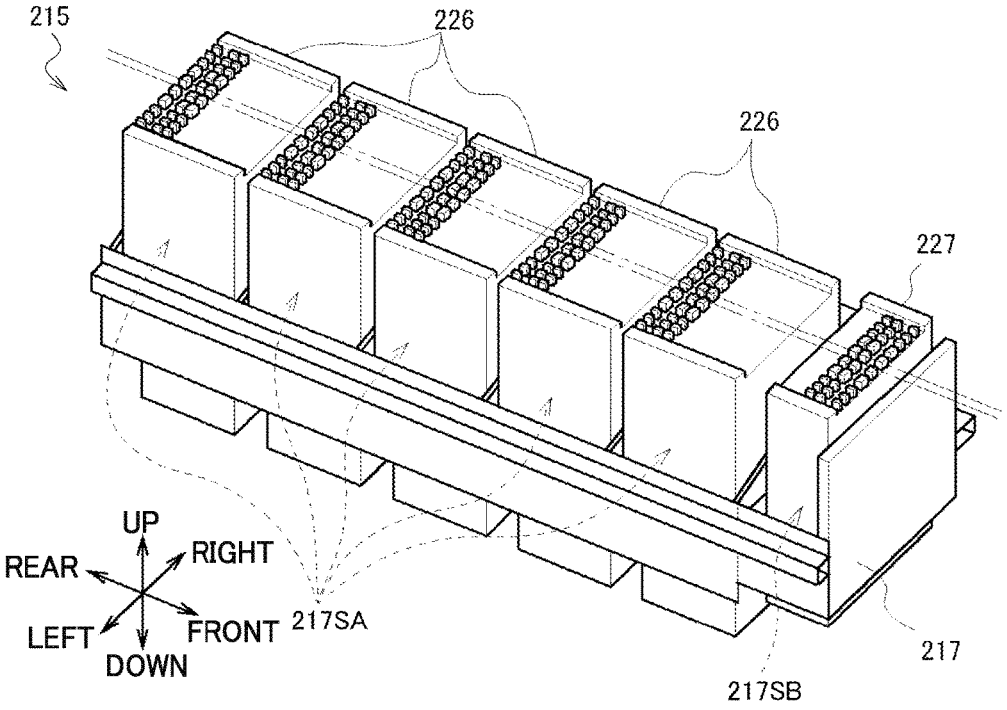
FIG. 13A is a schematic perspective view illustrating configuration of a lower unit and a lower frame according to the third exemplary embodiment.
Figure 13B:
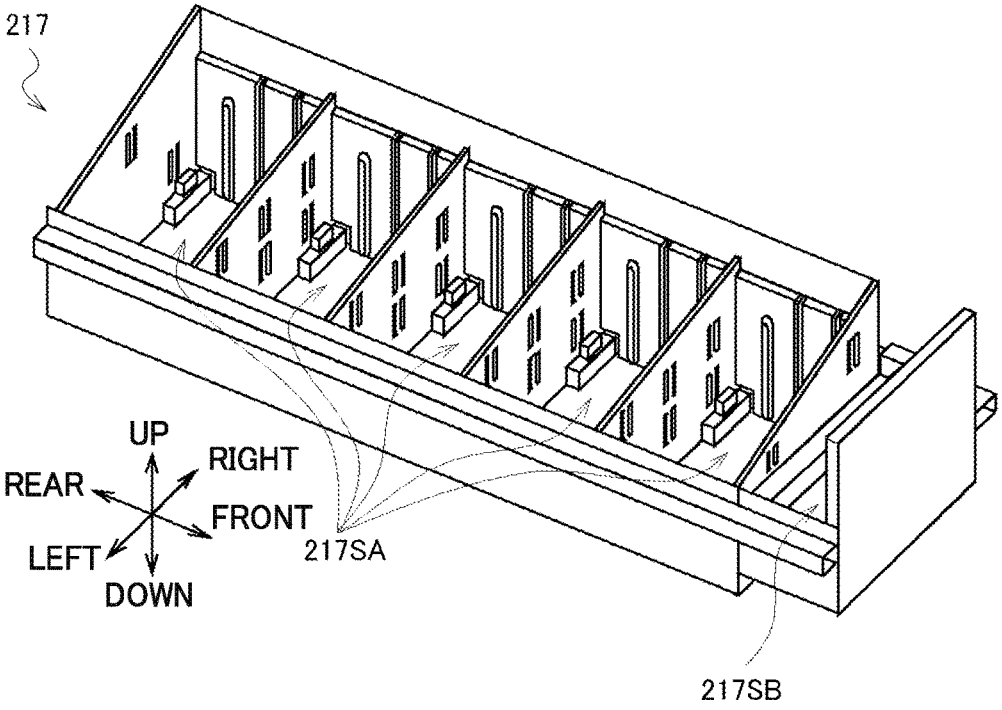
FIG. 13B is a schematic perspective view illustrating configuration of the lower frame according to the third exemplary embodiment.

Moreover, as illustrated in FIG. 13A and FIG. 13B, in the lower unit 215, five slots 17SA and a single slot 17SB are disposed in a row along the front-rear direction in a lower frame 217 attached to the slide rails 16. Each of the slots 17SA and 17SB is configured by a rectangular shaped hole penetrating in the vertical direction. A portion that supports a respective banknote storage box 226 or the reject storage box 227 is provided below a rear inside face of each of the slots 17SA and 17SB.

Figure 14A:
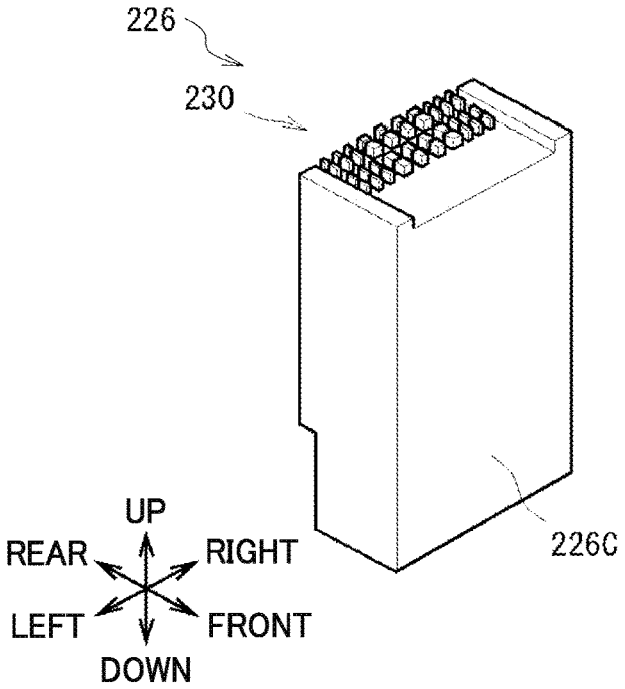
FIG. 14A is a schematic perspective view illustrating configuration of a banknote storage box according to the third exemplary embodiment.
Figure 14B:
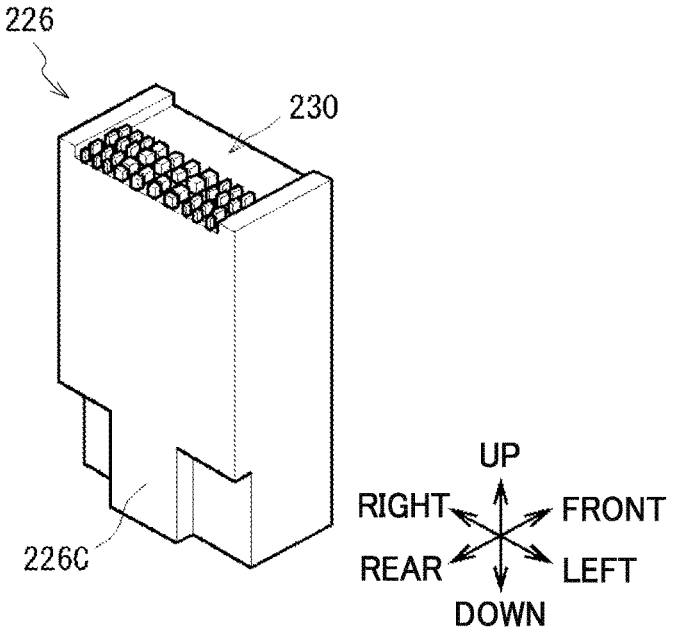
FIG. 14B is a schematic perspective view illustrating configuration of the banknote storage box according to the third exemplary embodiment.

On the other hand, as illustrated in FIG. 14A, which corresponds to FIG. 4A, and FIG. 14B, each banknote storage box 226 is formed overall in a cuboidal shape elongated in the vertical direction, and the portions projecting out in the left-right direction are omitted in comparison to the banknote storage boxes 26. Portions indented toward the front are formed in the vicinity of lower ends on both left and right sides of a rear face of a storage box casing 226C of each banknote storage box 226. Moreover, a banknote storage box guidance section 230 is formed at the rear side of an upper face of each banknote storage box 226.

Figure 15A:
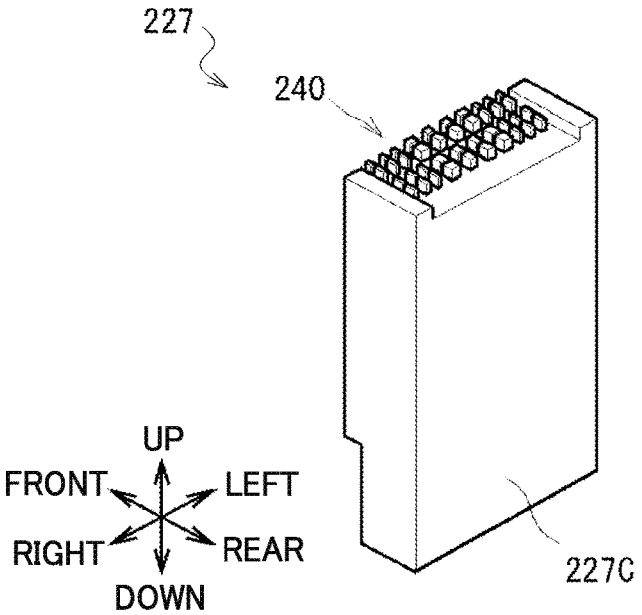
FIG. 15A is a schematic perspective view illustrating configuration of a reject storage box according to the third exemplary embodiment.
Figure 15B:
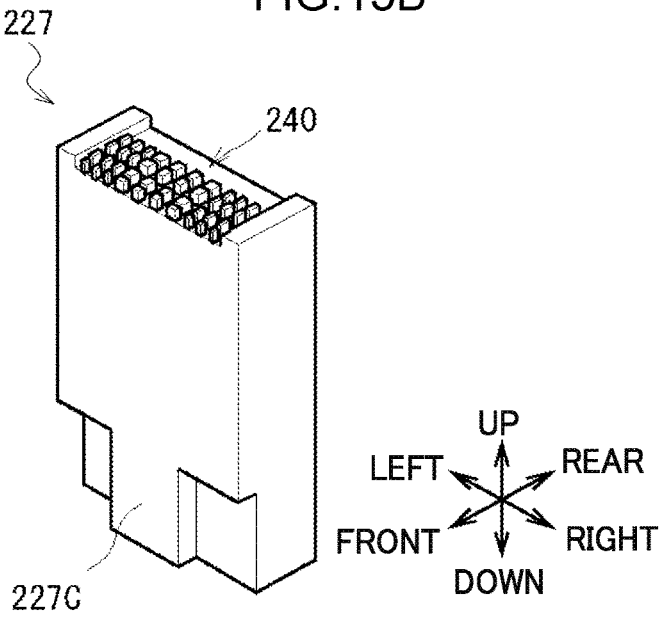
FIG. 15B is a schematic perspective view illustrating configuration of the reject storage box according to the third exemplary embodiment.

As illustrated in FIG. 15A and FIG. 15B, corresponding to FIG. 14A and FIG. 14B, the reject storage box 227 is formed overall in a cuboidal shape elongated in the vertical direction, and shorter in the front-rear direction than the banknote storage boxes 226. Moreover, similarly to in the banknote storage boxes 226, portions indented toward the front are respectively formed in the vicinity of lower ends on both left and right sides of a rear face of a storage box casing 227C of the reject storage box 227. Moreover, a reject storage box guidance section 240 is formed toward the front of an upper face of the reject storage box 227. Namely, in the banknote pay-in/pay-out device 210, the positions of the banknote storage box guidance sections 230 of the banknote storage boxes 226 and the position of the reject storage box guidance section 240 of the reject storage box 227 are reversed front-to-rear.

3-2. Configuration of Guidance Section and Handover Section for Banknote Storage Box Next, explanation follows regarding configuration of the banknote storage box guidance section 230 of the banknote storage boxes 226 and the handover section 228.

Figure 16:
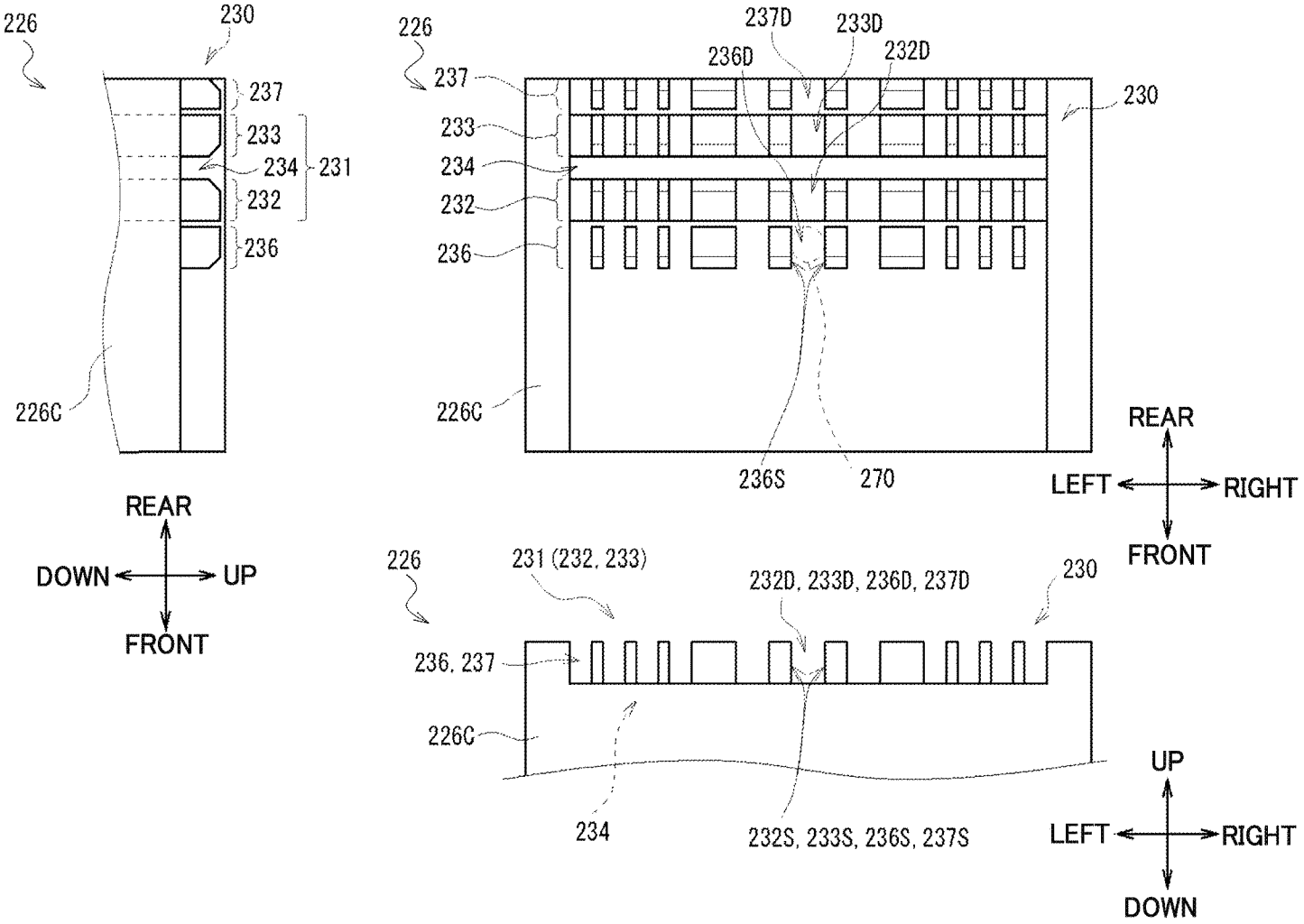
FIG. 16 is a schematic three-plane diagram illustrating configuration of a banknote storage box guidance section according to the third exemplary embodiment.

As illustrated in FIG. 16, which corresponds to FIG. 5, each banknote storage box guidance section 230 is provided with an inner storage box conveyance guide 232 disposed at a position close to the center of the banknote storage box 226, namely on the inside, and an outer storage box conveyance guide 233 disposed at a position further away from the center of the banknote storage box 226, namely on the outside.

For ease of explanation, hereafter the inner storage box conveyance guide 232 and the outer storage box conveyance guide 233 are also referred to collectively as a storage box conveyance guide group 231. Moreover, a conveyance space 234 that is similar to the conveyance space 34 of the first exemplary embodiment is formed between the inner storage box conveyance guide 232 and the outer storage box conveyance guide 233.

Similarly to in the rear storage box conveyance guide 33 (FIG. 5) of the first exemplary embodiment, in the outer storage box conveyance guide 233 plural fingers, are disposed at discrete locations from each other with gaps formed therebetween. However, although the inner storage box conveyance guide 232 is generally similar in configuration to the front storage box conveyance guide 32 of the first exemplary embodiment in that plural fingers are disposed at discrete locations from each other with gaps formed therebetween, the shape is partially different. Namely, the inner storage box conveyance guide 232 does not have a shape with front-rear symmetry to the outer storage box conveyance guide 233.

A protective finger section 236 is provided at the front side of the inner storage box conveyance guide 232 at an upper face of the storage box casing 226C. Moreover, a protective finger section 237 is provided at the rear side of the outer storage box conveyance guide 233. The protective finger section 236 is configured by plural fingers projecting upward from the upper face of the storage box casing 226C. The size and placement of each finger in the left-right direction and the vertical direction are similar to those of the respective fingers of the inner storage box conveyance guide 232. Accordingly, the spacings between the respective fingers are likewise similar to those of the inner storage box conveyance guide 232. Although the protective finger section 237 is generally configured with front-rear symmetry with respect to the protective finger section 236, the front-rear direction length of the protective finger section 237 is shorter than that of the protective finger section 236 due to placement constraints and the like. The protective finger sections 236 and 237 are configured from a comparatively high strength resin material similar to that of the storage box casing 226C, so as to protect the respective fingers of the inner storage box conveyance guide 232 and the outer storage box conveyance guide 233.

Figure 17A:
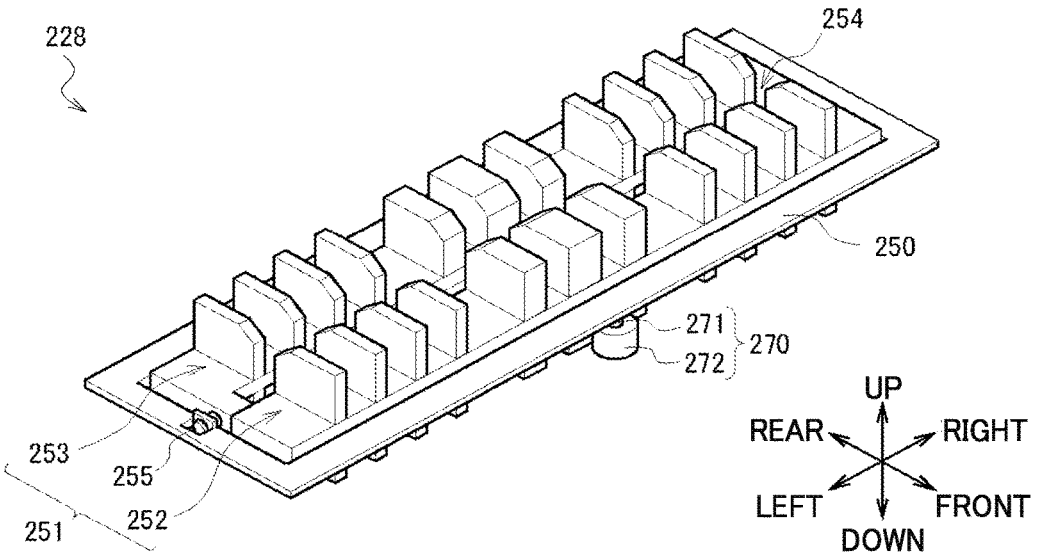
FIG. 17A is a schematic perspective view illustrating configuration of a handover section according to the third exemplary embodiment.
Figure 17B:
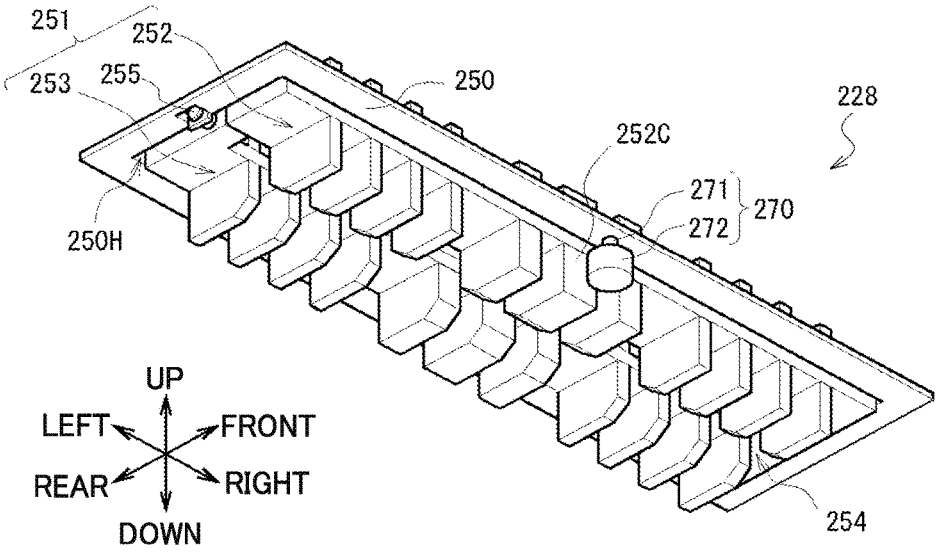
FIG. 17B is a schematic perspective view illustrating configuration of the handover section according to the third exemplary embodiment.
Figure 18:
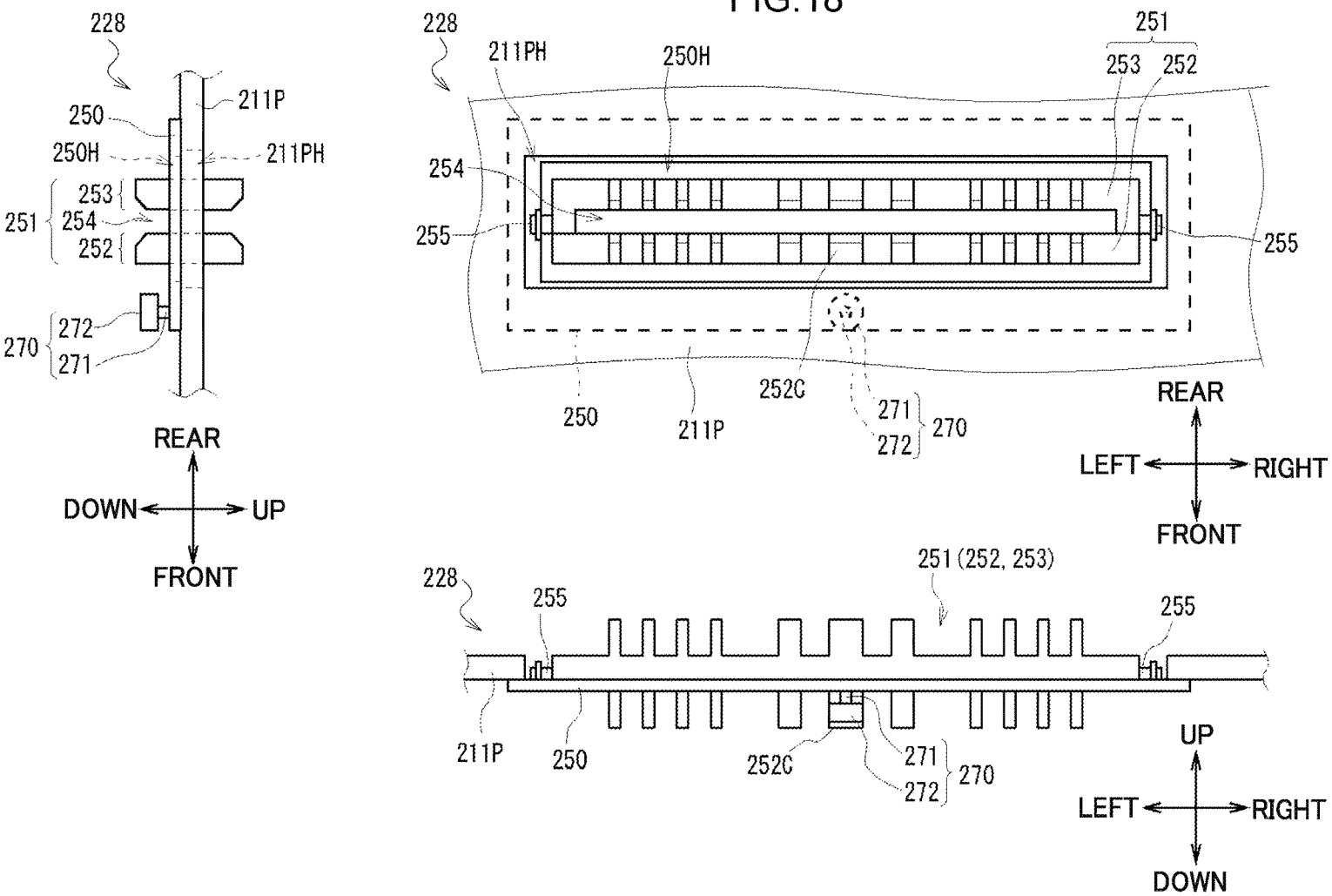
FIG. 18 is a schematic three-plane diagram illustrating configuration of a handover section according to the third exemplary embodiment.

On the other hand, as illustrated in perspective view in FIG. 17A and FIG. 17B, and as illustrated in the three-plane diagram of FIG. 18 corresponding to FIG. 6, the handover section 228 is configured with various components attached to a handover frame 250. A hole 250H, configured by an angular hole that penetrates in the vertical direction and is elongated in the left-right direction, is formed at the center of the handover frame 250. An inner handover section conveyance guide 252 and an outer handover section conveyance guide 253 are provided in the hole 250H at respective locations toward the front and toward the rear of the center thereof.

For ease of explanation, hereafter the inner handover section conveyance guide 252 and the outer handover section conveyance guide 253 are also referred to collectively as a handover section conveyance guide group 251.

Similarly to the front handover section conveyance guide 52 (FIG. 6) of the first exemplary embodiment, the inner handover section conveyance guide 252 includes fingers and gaps formed so as to complement the respective fingers and gaps of the inner storage box conveyance guide 232. The outer handover section conveyance guide 253 includes fingers and gaps formed so as to complement the respective fingers 43 and gaps 44 of the outer storage box conveyance guide 233. Note that since the shapes of the inner storage box conveyance guide 232 and the outer storage box conveyance guide 233 are not front-rear symmetrical to each other, the outer handover section conveyance guide 253 is likewise not front-rear symmetrical to the inner handover section conveyance guide 252.

The inner handover section conveyance guide 252 is attached to the outer handover section conveyance guide 253 in a state in which a conveyance space 254 is formed between the outer handover section conveyance guide 253 and the inner handover section conveyance guide 252. Moreover, the outer handover section conveyance guide 253 is configured capable of swinging with respect to the handover frame 250 about a rotation shaft 255.

The handover section 228 is attached to a lower face side of the partitioning portion 211P such that the position of the hole 250H in the handover frame 250 aligns with a partition hole 211PH formed in the partitioning portion 211P of the casing 211.

Moreover, a position establishing section 270, corresponding to the position establishing section 70 of the first exemplary embodiment, is provided in the vicinity of the center at the front side of the lower face of the handover frame 250 of the handover section 228, namely at the front side of a central finger 252C positioned substantially at the left-right center of the inner handover section conveyance guide 252.

The position establishing section 270 is configured by a support column 271 and a circular disk 272 corresponding to the support column 71 and the circular disk 72 of the first exemplary embodiment, respectively. The diameter of the circular disk 272 is slightly longer than the left-right direction length of the central finger 252C. Namely, the diameter of the circular disk 272 is slightly shorter than the left-right direction length of a central gap 232D positioned at the center of the inner storage box conveyance guide 232 in the banknote storage box guidance section 230 (FIG. 16), and a central gap 233D positioned at the center of the outer storage box conveyance guide 233 in the banknote storage box guidance section 230. Namely, the diameter of the circular disk 272 is slightly shorter than a central gap 236D of the protective finger section 236 and a central gap 237D of the protective finger section 237 in the banknote storage box guidance section 230.

The central gap 232D is a gap between two central guiding side-faces 232S, these being mutually facing side faces of the two fingers positioned at the center of the inner storage box conveyance guide 232. Similarly, the central gaps 233D, 236D, and 237D are each gaps between two central guiding side-faces 233S, 236S, and 237S.

3-3. Configuration of Guidance Section and Handover Section for Reject Storage Box Next, explanation follows regarding configuration of the reject storage box guidance section 240 of the reject storage box 227 and the handover section 229.

Figure 19:
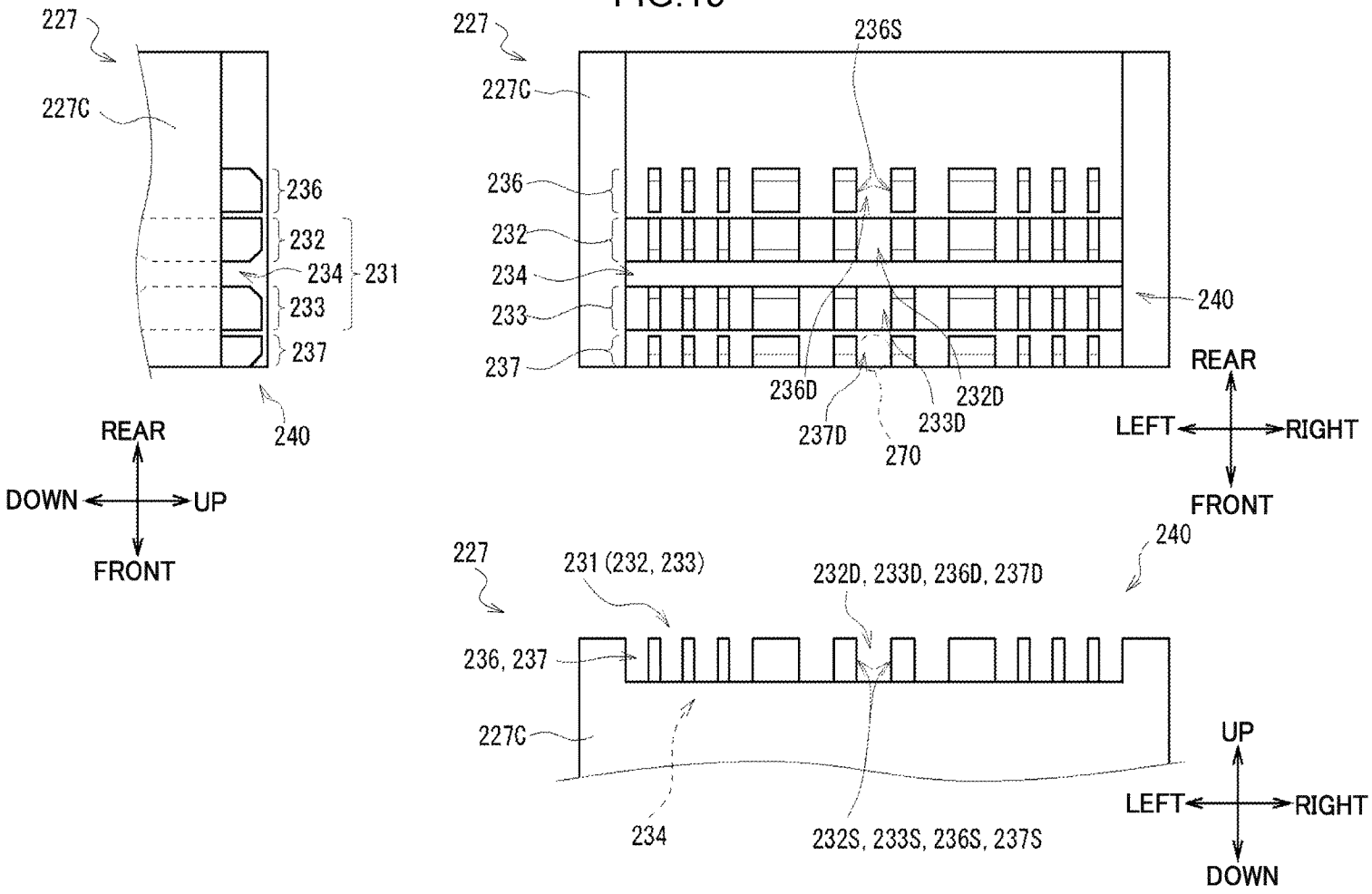
FIG. 19 is a schematic three-plane diagram illustrating configuration of a reject storage box guidance section according to the third exemplary embodiment.

As illustrated in FIG. 19, which corresponds to FIG. 16, the reject storage box guidance section 240 is provided with an inner storage box conveyance guide 232 disposed at a position close to the center of the reject storage box 227, namely on the inside, and an outer storage box conveyance guide 233 disposed at a position further away from the center of the reject storage box 227, namely on the outside. Namely, the reject storage box guidance section 240 is provided such that the inner storage box conveyance guide 232 and the outer storage box conveyance guide 233 are reversed front-to-rear when compared to those of the banknote storage box guidance section 230.

At an upper face of the storage box casing 227C, a protective finger section 237 is provided at the front side of the outer storage box conveyance guide 233, and a protective finger section 236 is provided at a rear side of the inner storage box conveyance guide 232, so as to be reversed front-to-rear when compared to those of the banknote storage boxes 226.

Figure 20A:
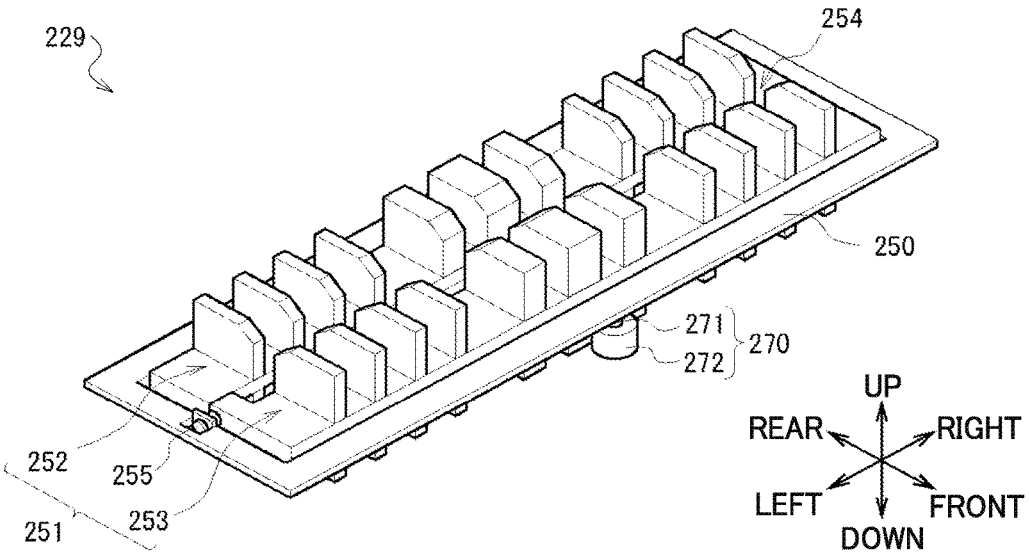
FIG. 20A is a schematic perspective view illustrating configuration of the handover section according to the third exemplary embodiment.
Figure 20B:
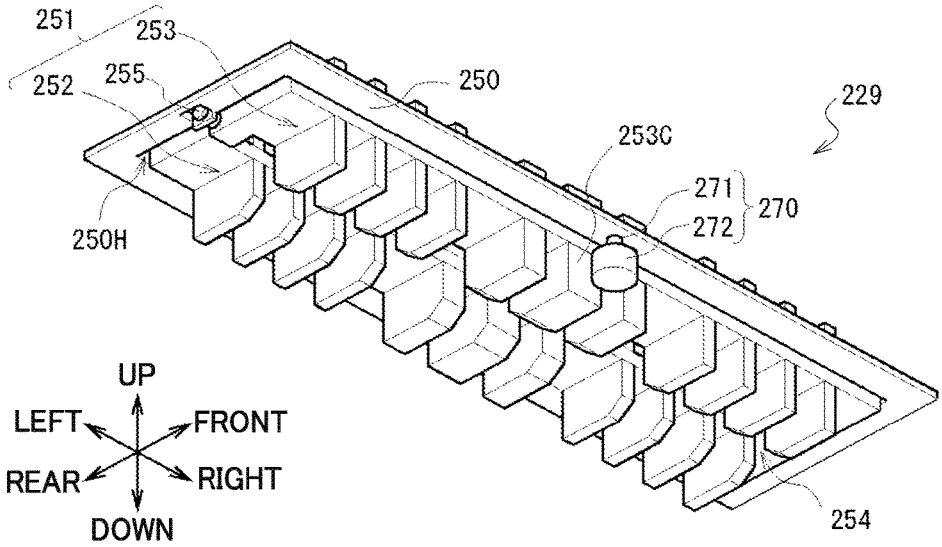
FIG. 20B is a schematic perspective view illustrating configuration of the handover section according to the third exemplary embodiment.
Figure 21:
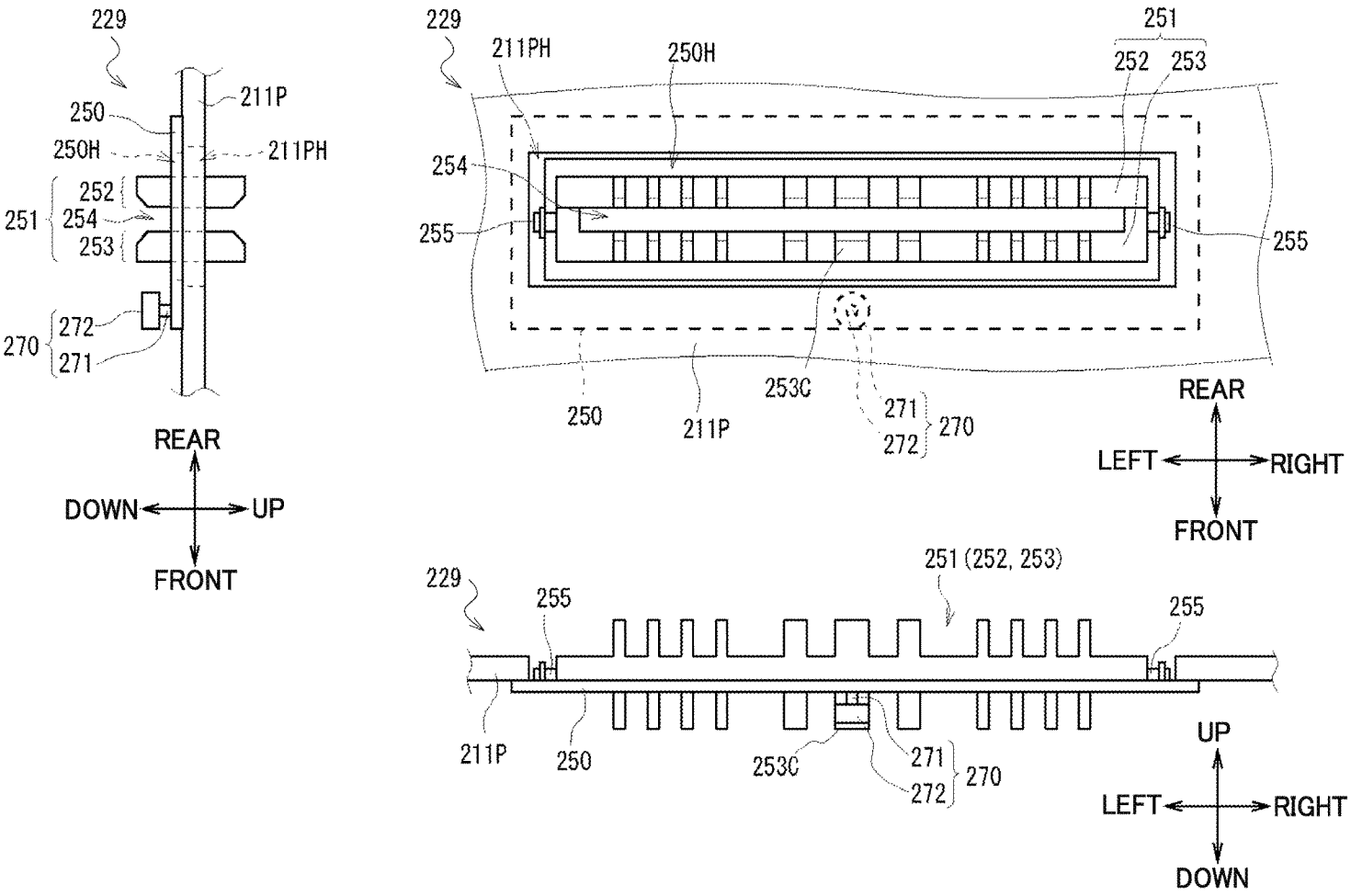
FIG. 21 is a schematic three-plane diagram illustrating configuration of the handover section according to the third exemplary embodiment.

In the handover section 229, as illustrated in FIG. 20A, FIG. 20B, and FIG. 21, corresponding to FIG. 17A, FIG. 17B, and FIG. 18, respectively, the inner handover section conveyance guide 252 and the outer handover section conveyance guide 253 are provided so as to be reversed front-to-rear when compared to those of the handover sections 228.

Similarly to in the handover sections 228, the handover section 229 is provided with a position establishing section 270 in the vicinity of the center at the front side of a lower face of the handover frame 250. Namely, in the handover section 229, unlike in the handover sections 228, the position establishing section 270 is provided at the front side of a central finger 253C positioned substantially at the left-right center of the outer handover section conveyance guide 253.

3-4 Positioning Between Conveyance Guides

As described above, in the banknote pay-in/pay-out device 210, the banknote storage boxes 226 and the reject storage box 227 are able to be disposed at their respective facing positions by loading the banknote storage boxes 226 and the reject storage box 227 into respective slots 217S in the lower frame 217 (FIG. 13B) and storing the lower frame 217 inside the casing 211.

When this is performed, a positioning pin (not illustrated in the drawings) provided to each slot 217S of the lower frame 217 is inserted into a positioning hole (not illustrated in the drawings) provided in a top face of the respective indented portion in the rear faces of the banknote storage boxes 226 (FIG. 14A and FIG. 14B) and the reject storage box 227 (FIG. 15A and FIG. 15B). Accordingly, the front-rear direction, left-right direction, and vertical direction positions of the banknote storage boxes 226 and the reject storage box 227 are established with respect to the lower frame 217, and the vertical direction and left-right direction positions are aligned with each other so as to adopt a state in which the banknote storage boxes 226 and the reject storage box 227 form a row along the front-rear direction.

At upper faces of each of the banknote storage boxes 226 and the reject storage box 227 loaded into the respective slots 217S of the lower frame 217, the respective inner storage box conveyance guides 232 and outer storage box conveyance guides 233 (FIG. 16) of the banknote storage box guidance sections 230 and the reject storage box guidance section 240 adopt a state in which the positions of their respective finger sections and gaps are aligned in the left-right direction.

When this occurs, the central gap 232D of each inner storage box conveyance guide 232, the central gap 233D of each outer storage box conveyance guides 233, the central gap 236D of the protective finger section 236, and the central gap 237D of the protective finger section 237 may be considered to form a single long virtual groove running along the front-rear direction across each of the banknote storage boxes 226 and the reject storage box 227, as illustrated by the single-dotted dashed lines in FIG. 13A.

Accordingly, similarly to in the first exemplary embodiment, in the banknote pay-in/pay-out device 210, the left-right direction position of the banknote storage boxes 226 and the reject storage box 227 may be established with respect to the handover sections 228 and the handover section 229 by the combination of the central gaps 232D, 233D, 236D, and 237D and the position establishing sections 270.

Namely, as the banknote storage boxes 226 travel toward the rear inside the lower space 211SL, firstly, the central guiding side-faces 237S of the protective finger section 237 on the rear side are guided by the position establishing section 270 positioned at the front side of the inner handover section conveyance guide 252 and the outer handover section conveyance guide 253 of each handover sections 228 and the like, thereby precisely establishing the left-right direction position of each banknote storage box 226.

Then, the central guiding side-face 233S of the outer storage box conveyance guide 233, the central guiding side-face 232S of the inner storage box conveyance guide 232, and the central guiding side-face 236S of the protective finger section 236 at the front side of each of the banknote storage boxes 226 are guided in sequence by the position establishing sections 270, thereby precisely establishing the left-right direction position of each banknote storage box 226.

Similarly to the banknote storage boxes 226, the respective central guiding side-faces 236S, 232S, 233S, and 237S of the reject storage box 227 are likewise guided in sequence by the position establishing sections 270, thereby precisely establishing the left-right direction position of the reject storage box 227.

Accordingly, in the banknote pay-in/pay-out device 210, the respective fingers of the inner storage box conveyance guides 232 and the outer storage box conveyance guides 233 of the banknote storage boxes 226 and the like, and the respective fingers of the inner handover section conveyance guides 252 and the outer handover section conveyance guides 253 of the handover sections 228 and the like may be interlocked with each other while not abutting and while preventing damage due to collisions.

In particular, in the banknote pay-in/pay-out device 210, the central gap 236D of the protective finger section 236 and the central gap 237D of the protective finger section 237 provided to the upper faces of the respective banknote storage boxes 226 and the like, as well as the central gap 232D of the inner storage box conveyance guide 232 and the central gap 233D of the outer storage box conveyance guide 233, function similarly to the groove 36 (FIG. 5) of the first exemplary embodiment. Accordingly, in the banknote pay-in/pay-out device 210, there is no need to extend the left-right direction length of upper-side portions of the banknote storage boxes 226 and the reject storage box 227 more than that of lower-side portions of the banknote storage boxes 226 and the reject storage box 227, such as in the case of the banknote storage boxes 26 (FIG. 4A) of the first exemplary embodiment, thereby enabling a more compact configuration.

Note that in the banknote storage boxes 226, from the perspective of preventing the occurrence of static electricity during banknote conveyance, the inner storage box conveyance guide 232 and the outer storage box conveyance guide 233 are configured from an electrically conductive resin material, which causes the strength of the static electricity to decrease somewhat. In contrast, in the banknote storage boxes 226, the protective finger sections 236 and 237 are configured from a comparatively high strength resin material similar to that of the storage box casing 226C.

Accordingly, in the banknote pay-in/pay-out device 210, the protective finger section 236 and the protective finger section 237 are disposed at the upper face of each banknote storage box 226 and the like at the front side and the rear side of the inner storage box conveyance guide 232 and the outer storage box conveyance guide 233, respectively (FIG. 16). The position establishing sections 270 may accordingly be made to abut the high-strength protective finger sections 236 and 237 before the low-strength inner storage box conveyance guide 232 and the outer storage box conveyance guide 233 when the lower frame 217 slides in the front-rear direction in the banknote pay-in/pay-out device 210, and thereby perform positioning. Accordingly, the banknote pay-in/pay-out device 210 is able to prevent damage to the respective fingers of the inner storage box conveyance guides 232 and the outer storage box conveyance guides 233.

Figure 22A:
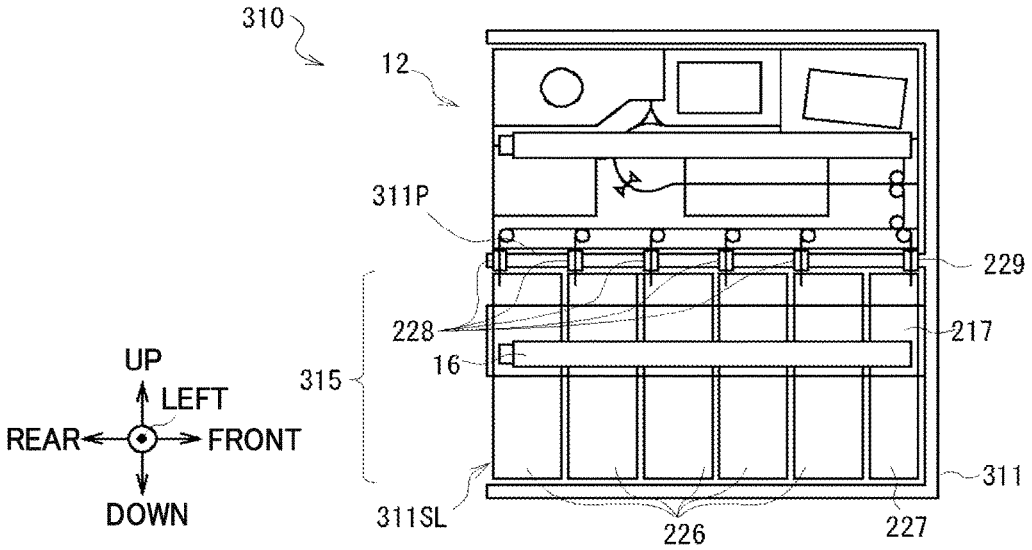
FIG. 22A is a schematic view illustrating configuration of a banknote pay-in/pay-out device of a rear-facing type.
Figure 22B:
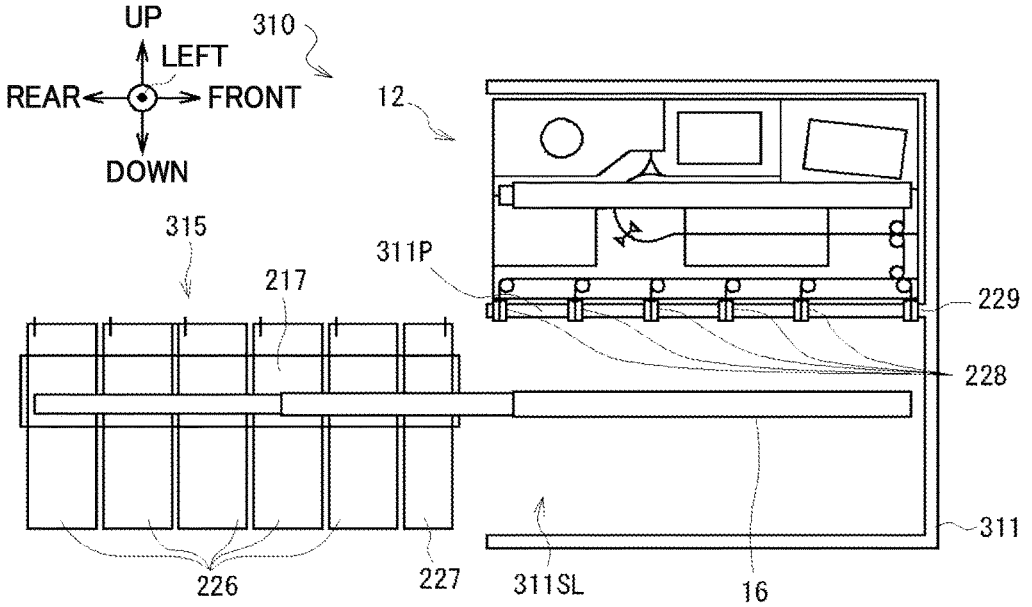
FIG. 22B is a schematic view illustrating configuration of the banknote pay-in/pay-out device of the rear-facing type.
Figure 23A:
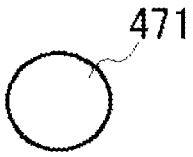
FIG. 23A is a schematic view illustrating configuration of a position establishing section according to another exemplary embodiment.
Figure 23B:
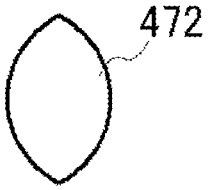
FIG. 23B is a schematic view illustrating configuration of a position establishing section according to another exemplary embodiment.
Figure 23C:
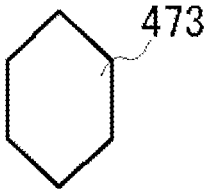
FIG. 23C is a schematic view illustrating configuration of a position establishing section according to another exemplary embodiment.
Figure 23D:
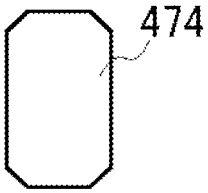
FIG. 23D is a schematic view illustrating configuration of a position establishing section according to another exemplary embodiment.

Note that, as illustrated in FIG. 22A and FIG. 22B, corresponding to FIG. 12A and FIG. 12B, the configuration of a banknote pay-in/pay-out device 310 corresponding to the banknote pay-in/pay-out device 210 is envisaged. In the banknote pay-in/pay-out device 310, configuration is made such that the upper unit 12 and a lower unit 315 are pulled out toward the rear with respect to a casing 311, conversely to in the banknote pay-in/pay-out device 210. For ease of explanation, hereafter the banknote pay-in/pay-out device 210 in which the lower unit 215 and the like are pulled out toward the front is also referred to as a front-facing device, and the banknote pay-in/pay-out device 310 in which the lower unit 315 and the like are pulled out toward the rear is also referred to as a rear-facing device.

Note that in the banknote storage boxes 226, the outer storage box conveyance guide 233 is disposed at the rear side of the conveyance space 234 (FIG. 16). Accordingly, in the handover section corresponding to each banknote storage box 226, the outer handover section conveyance guide 253 corresponding to the outer storage box conveyance guide 233 needs to be positioned at the rear side of the conveyance space 254, and the position establishing section 270 needs to be disposed at the rear side of the handover section conveyance guide group 251. In the banknote pay-in/pay-out device 310, a handover section 229 (FIG. 20A, FIG. 20B, and FIG. 21) is attached to the upper side of the banknote storage box 226 that meets these conditions by being reversed front-to-rear compared that of the banknote pay-in/pay-out device 210.

Moreover, in the reject storage box 227, the outer storage box conveyance guide 233 is disposed at the front side of the conveyance space 234 (FIG. 19). Accordingly, in the handover section corresponding to the reject storage box 227, the outer handover section conveyance guide 253 corresponding to the outer storage box conveyance guide 233 needs to be positioned at the front side of the conveyance space 254, and the position establishing section 270 needs to be disposed at the front side of the handover section conveyance guide group 251. In the banknote pay-in/pay-out device 310, a handover section 228 (FIG. 17A, FIG. 17B, and FIG. 18) is attached to the upper side of the reject storage box 227 that meets these conditions by being reversed front-to-rear compared that of the case of the banknote pay-in/pay-out device 210.

In this manner, the handover sections 228 and 229 of the banknote pay-in/pay-out device 210 (FIG. 12A and FIG. 12B) may also be employed in the banknote pay-in/pay-out device 310 (FIG. 22A and FIG. 22B) by making appropriate changes to the attachment positions and attachment directions. Namely, configuration components may be made common to the banknote pay-in/pay-out device 210 and the banknote pay-in/pay-out device 310, enabling a reduction in manufacturing costs.

In other respects, the banknote pay-in/pay-out device 210 according to the third exemplary embodiment is able to exhibit similar operation and effects to those of the first exemplary embodiment.

According to the above configuration, the banknote pay-in/pay-out device 210 of the ATM 201 according to the third exemplary embodiment is provided with the position establishing section 270 at the front side of the handover section conveyance guide groups 251 of the handover sections 228 and 229. In the banknote pay-in/pay-out device 210, when storing the lower frame 217 loaded with the banknote storage boxes 226 and the like in the casing 211, the central guiding side-faces 237S of each protective finger section 237, the central guiding side-faces 233S of each outer storage box conveyance guide 233, the central guiding side-faces 232S of each inner storage box conveyance guide 232, and the central guiding side-faces 236S of each protective finger section 236 are guided in sequence by the position establishing sections 270. Accordingly, in the banknote pay-in/pay-out device 210, the finger sections of the storage box conveyance guide group 231 and the finger sections of the handover section conveyance guide group 251 are able to interlock with each other without abutting.

4. Other Exemplary Embodiments

In the first exemplary embodiment above, explanation has been given regarding a case in which the position establishing section 70 is configured by the support column 71 and the circular disk 72, and the circular disk 72 is made rotatable with respect to the support column 71. However, the present disclosure is not limited thereto, and, for example, the circular disk 72 may be fixed with respect to the support column 71, or the position establishing section 70 may be configured with various other shapes.

For example, the position establishing section 70 may be configured in a column shape that runs along the vertical direction and that has a profile, as viewed from above, configured by a circular shape, a combination of circular arcs, a hexagonal shape, an octagonal shape, or the like, such as in position establishing sections 471, 472, 473, and 474 illustrated in FIG. 23A, FIG. 23B, FIG. 23C, and FIG. 23D. In cases such as these in which the position establishing sections 471 and the like do not rotate, a member that improves sliding properties may be affixed to at least one location where sliding occurs between the position establishing sections 471 or the like and the groove 36. The same also applies in the second and third exemplary embodiments.

Figure 24A:
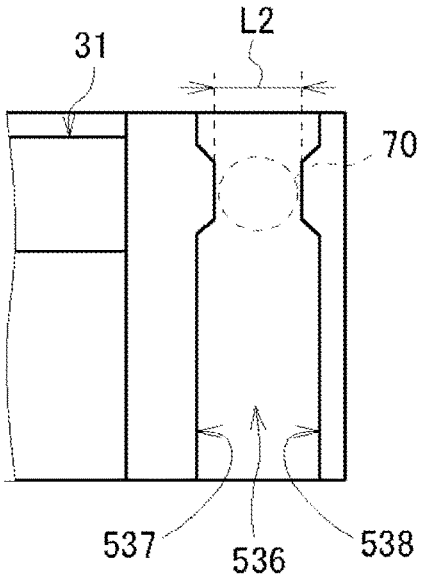
FIG. 24A is a schematic view illustrating configuration of a groove according to another exemplary embodiment.

Moreover, in the first exemplary embodiment described above, explanation has been given regarding a case in which the groove width of the groove 36 is uniform, and the left guiding side-face 37 and the right guiding side-face 38 are each configured as flat faces. However, the present disclosure is not limited thereto, and, for example, as in a groove 536 illustrated in FIG. 24A, the groove width may be set to length L2 similar to that of the groove 36 only in the vicinity of the storage box conveyance guide group 31, with the groove width being configured wider at other portions. This thereby enables the likelihood to be decreased of the circular disk 72 of the position establishing section 70 abutting a left guiding side-face 537 or a right guiding side-face 538 of the groove 536 during front-rear direction movement of the lower frame 17, even if the lower frame 17 swings in the left-right direction.

Figure 24B:
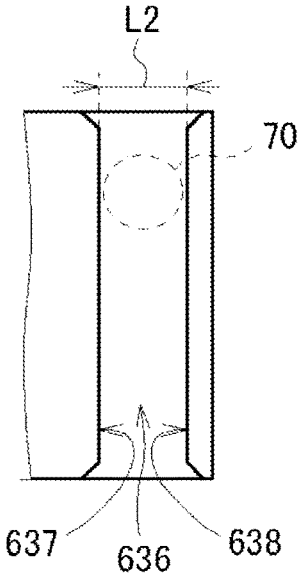
FIG. 24B is a schematic view illustrating configuration of a groove according to another exemplary embodiment.

Alternatively, as in a groove 636 illustrated in FIG. 24B, inclined portions or the like may be configured in the vicinity of front and rear end portions of a left guiding side-face 637 and a right guiding side-face 638, with the groove width gradually increasing from the length L2 on progression toward the front end and the rear end only in the vicinity of the front and rear end portions. This enables the position establishing section 70 to be led into the groove 636 even in cases in which the banknote storage boxes 26 and the like swing with a comparatively large amplitude in the left-right direction, thereby enabling the left-right direction positions of the banknote storage boxes 26 and the like to be brought closer to the facing positions. The same also applies in the second and third exemplary embodiments.

Figure 25A:
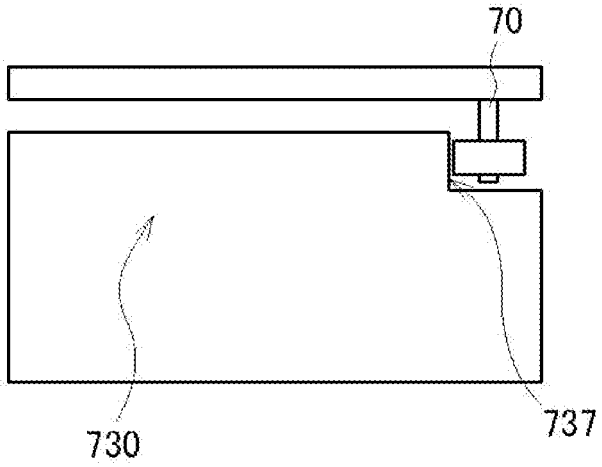
FIG. 25A is a schematic view illustrating configuration of a position establishing section and a guiding side-face according to another exemplary embodiment.

Moreover, in the first exemplary embodiment above, explanation has been given regarding a case in which the groove 36 is provided to the storage box guidance section 30, and both the left and right direction positions of the storage box guidance section 30 are established by the position establishing section 70 entering the groove 36. However, the present disclosure is not limited thereto, and, for example, as illustrated in FIG. 25A, a step shaped left guiding side-face 737 may be provided in the vicinity of the right end of a storage box conveyance section 730 in place of the left guiding side-face 37 of the groove 36, such that the position is established only toward the right for the banknote storage boxes 26 and the like.

Figure 25B:
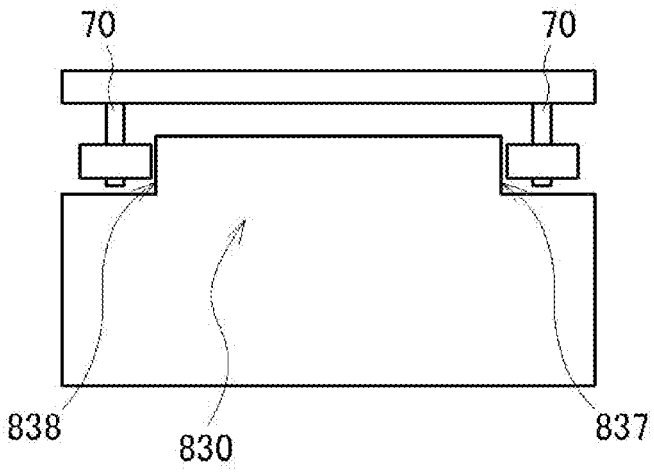
FIG. 25B is a schematic view illustrating configuration of a position establishing section and a guiding side-face according to another exemplary embodiment.

Alternatively, as illustrated in FIG. 25B, a left guiding side-face 837 and a right guiding side-face 838 each configured with a step shape may be provided in the vicinity of the left and right ends of a storage box conveyance section 830, and position establishing sections 70 may be provided at two locations, the left and right, such that the position is established toward the left and right for the banknote storage boxes 26 and the like. This thereby enables position to be established toward at least one direction from of the of the left and right, even when space constraints prevent the formation of a groove 36 with a sufficient groove width, for example in cases in which the left-right direction length of the banknote storage boxes 26 is comparatively short. The same also applies in the second and third exemplary embodiments.

Moreover, in the first exemplary embodiment above, explanation has been given regarding a case in which abutting of the finger sections 42 and the finger sections 62 is avoided by respectively setting the width of the gap 44K (length L4), the width of the finger 63K (length L3), the groove width of the groove 36 (length L2), and the diameter of the circular disk 72 (length L1) such that the difference value ΔL12 is smaller than the difference value ΔL34 (FIG. 8). However, the present disclosure is not limited thereto, and, for example, the difference value ΔL34 may be equal to the difference value ΔL12, such that the finger section 42 and the finger section 62 are permitted to abut each other. The same also applies in the second and third exemplary embodiments.

Moreover, in the third exemplary embodiment above, explanation has been given regarding a case in which a single position establishing section 270 is provided to each of the handover sections 228 and 229 (FIG. 17A, FIG. 17B, FIG. 18, FIG. 20A, FIG. 20B, and FIG. 21). However, the present disclosure is not limited thereto, and, for example, two or more of the position establishing sections 270 may be provided in a row along the left-right direction on each of the handover sections 228 and 229. In such cases, the positions and sizes of the respective position establishing sections 270 may be adjusted to match the respective fingers of the inner handover section conveyance guide 252 and the like.

Alternatively, in the handover section 228, for example, a position establishing section 270 may be disposed at the rear side of the outer handover section conveyance guide 253 as well as at the front side of the inner handover section conveyance guide 252. This thereby enables collisions between the fingers to be effectively prevented not only when the banknote storage boxes 226 and the like move toward the rear inside the casing 211 but also when the banknote storage boxes 226 and the like move toward the front inside the casing 211. Moreover, in such cases, the handover section 229 has the same configuration as the handover sections 228, enabling a reduction in costs to be achieved as a result of making the components common.

Moreover, in the third exemplary embodiment above, explanation has been given regarding a case in which the protective finger section 236 and the protective finger section 237 are respectively provided at the front and rear of the inner storage box conveyance guide 232 and the outer storage box conveyance guide 233 at the upper face of the banknote storage box 226 or the like. Moreover, the respective fingers of the protective finger sections 236 and 237 have the same shape as the respective fingers of the inner storage box conveyance guide 232 and the outer storage box conveyance guide 233. However, the present disclosure is not limited thereto, and, for example, some of the fingers of the protective finger sections 236 and 237 may be omitted. In such cases, it is preferable that at least the fingers that form the central gaps 236D and 237D remain. Moreover, one or more of the protective finger sections 236 or 237 may be omitted.

Moreover, in the third exemplary embodiment above, explanation has been given regarding a case in which the inner storage box conveyance guide 232 and the outer storage box conveyance guide 233 do not have front-rear symmetry, and correspondingly, the inner handover section conveyance guide 252 and the outer handover section conveyance guide 253 do not have front-rear symmetry either. However, the present disclosure is not limited thereto, and, for example, the inner storage box conveyance guide 232 and the outer storage box conveyance guide 233 may be configured with front-rear symmetry, and, correspondingly, the inner handover section conveyance guide 252 and the outer handover section conveyance guide 253 may also be configured with front-rear symmetry. In such cases, the handover section 229 has the same configuration as the handover sections 228, thereby enabling a reduction in costs to be achieved as a result of making the components common.

Moreover, in the third exemplary embodiment above, explanation has been given regarding a case in which the position establishing section 270 is provided to each handover section 228 and the like so as to guide the central gap 232D of the inner storage box conveyance guide 232 and the like on the banknote storage box 226 side. However, the present disclosure is not limited thereto, and, for example, similarly to in the second exemplary embodiment (FIG. 10 and FIG. 11), the position establishing section 270 may be provided on the banknote storage box 226 side so as to guide gap portions between the fingers of the inner handover section conveyance guide 252 and the like on the handover section side.

Moreover, in the first exemplary embodiment above, explanation has been given regarding a case in which plural handover sections 28 are disposed in a row along the front-rear direction on the partitioning portion 11P of the casing 11, and the vertical direction and left-right direction attachment positions of the respective position establishing sections 70 are aligned with each other. However, the present disclosure is not limited thereto, and, for example, the vertical direction and left-right direction attachment positions of the respective position establishing section 70 may be made to differ from each other. In such cases, the groove width, groove depth, or the like of the grooves 36 formed in the storage box guidance sections 30 of the respective banknote storage boxes 26 and the like may be made to differ from each other. The same also applies in the second and third exemplary embodiments.

Moreover, in the first exemplary embodiment above, explanation has been given regarding a case in which the front handover section conveyance guide 52 and the rear handover section conveyance guide 53 swing about the rotation shafts 55 with respect to the handover frame 50 of the handover section 28. However, the present disclosure is not limited thereto, and, for example, the front handover section conveyance guide 52 and the rear handover section conveyance guide 53 may move in the vertical direction or the front-rear direction with respect to the handover frame 50. Alternatively, the front handover section conveyance guide 52 and the rear handover section conveyance guide 53 may be fixed with respect to the handover frame 50. The same also applies in the second and third exemplary embodiments.

Moreover, in the first exemplary embodiment above, explanation has been given regarding a case in which the lower frame 17 is moved in the front-rear direction with respect to the casing 11, and configuration is made such that banknotes are conveyed between the banknote storage boxes 26 and the like and the handover sections 28 along the vertical direction with sheet faces of the banknotes facing in the front-rear direction, with the left-right direction position of the conveyance guides being aligned by the grooves 36 and the position establishing sections 70. However, the present disclosure is not limited thereto. For example, the direction in which the lower frame 17 is moved, the banknote conveyance direction, and the direction in which the positions of the conveyance guides are aligned may be configured in various directions. In such cases, put simply, it is preferable to make configuration such that banknotes are conveyed and handed over in a state in which the sheet faces of the banknotes face along the detachable direction in which the lower frame 17 moves, in a conveyance direction intersecting the detachable direction, with the positions of conveyance guides being aligned with each other, by the grooves 36 and the position establishing sections 70, in a width direction intersecting either the detachable direction or the conveyance direction, such that the finger sections 42 and the finger sections 62 may be interlocked with each other without colliding. The same also applies in the second and third exemplary embodiments.

In the first exemplary embodiment described above, explanation has been given regarding a case in which the present disclosure is applied to the banknote pay-in/pay-out device 10 of an ATM 1 that performs cash transactions with a customer. However, the present disclosure is not limited thereto. For example, the present disclosure may be applied to various devices in which storage boxes are loaded and removed in a state in which a loading section has been pulled out from a device body using slide rails, such as in a banknote processing device (known as a teller machine) installed at a service counter of a financial institution primarily used by a staff member of the financial institution. The same also applies in the second and third exemplary embodiments.

In the first exemplary embodiment described above, explanation has been given regarding a case in which banknotes serving as a medium are stored in the banknote storage boxes 26. However, the present disclosure is not limited thereto. For example, the present disclosure may be applied to various devices in which banknote storage boxes store various media such as cash vouchers, securities, entrance tickets, or the like, and the banknote storage boxes are attached to and detached from a movable frame. The shape of the medium is not limited to paper sheet shapes such as that of banknotes, and may be various shapes such as rectangular cuboidal shapes. The same also applies in the second and third exemplary embodiments.

Moreover, the present disclosure is not limited to each of the exemplary embodiments described above, nor to the other exemplary embodiments described above. Namely, the present disclosure encompasses application to exemplary embodiments arising from selected combinations of some or all of the respective exemplary embodiments described above and the other exemplary embodiment described above, and exemplary embodiments arising from extracting parts therefrom.

Moreover, in the first exemplary embodiment above, explanation has been given regarding a case in which a handover section 28 and a storage box guidance section 30, serving as a medium conveyance device, are configured by a handover frame 50 serving as a first casing, a storage box casing 26C serving as a second casing, a front handover section conveyance guide 52 and rear handover section conveyance guide 53 serving as a first conveyance guide, a front storage box conveyance guide 32 and rear storage box conveyance guide 33 serving as a second conveyance guide, a finger section 62 serving as a first finger section, a finger section 42 serving as a second finger section, a left guiding side-face 37 and right guiding side-face 38 serving as guiding side-faces, and a position establishing section 70 serving as a position establishing section. However, the present disclosure is not limited thereto, and, for example, a medium conveyance device may be configured by various other configurations of a first casing, a second casing, a first conveyance guide, a second conveyance guide, a first finger section, a second finger section, guiding side-faces, and a position establishing section.

Moreover, in the first exemplary embodiment above, explanation has been given regarding a case in which the ATM 1, serving as a medium transaction device, is configured by a casing 11 serving as a first casing, a storage box casing 26C serving as a second casing, a front handover section conveyance guide 52 and rear handover section conveyance guide 53 serving as a first conveyance guide, a front storage box conveyance guide 32 and rear storage box conveyance guide 33 serving as a second conveyance guide, a finger section 62 serving as a first finger section, a finger section 42 serving as a second finger section, a left guiding side-face 37 and right guiding side-face 38 serving as guiding side-faces, and a position establishing section 70 serving as a position establishing section. However, the present disclosure is not limited thereto, and, for example, a medium transaction device may be configured by various other configurations of a first casing, a second casing, a first conveyance guide, a second conveyance guide, a first finger section, a second finger section, guiding side-faces, and a position establishing section.

INDUSTRIAL APPLICABILITY

The present disclosure may be employed in various devices such as, for example, ATMs, that are configured such that a storage box for storing a medium such as banknotes is attachable to and detachable from a frame, and in which the frame is slid so as to be stored inside a casing, with medium handover between the storage box and casing being performed when being stored.

The invention claimed is:

1. A medium conveyance device comprising:

a first casing;

a second casing that is configured to move in an detachable direction so as to be disposed at a facing position facing the first casing, or so as to be disposed away from the facing position;

a first conveyance guide that is provided to the first casing, and that is configured to guide a medium between the first casing and the second casing while the medium is conveyed along a conveyance direction intersecting the detachable direction when the second casing has been disposed at the facing position;

a second conveyance guide that is provided to the second casing at a location facing the first conveyance guide when the second casing has been disposed at the facing position, and that is configured to guide the medium together with the first conveyance guide;

a first finger section that is disposed at a location on the first conveyance guide facing the second conveyance guide, and that is provided with a plurality of first fingers respectively projecting out toward the second conveyance guide at discrete locations along a width direction intersecting both the detachable direction and the conveyance direction;

a second finger section that is disposed at a location on the second conveyance guide facing the first conveyance guide, and that is provided with a plurality of second fingers respectively projecting out toward the first conveyance guide at discrete locations along the width direction that are complementary locations to the respective first fingers of the first finger section;

a guiding side-face that is provided to one of the first casing or the second casing, and that is formed facing in the width direction and running along the detachable direction; and a position establishing section that is provided to the other of the first casing or the second casing, and that establishes a width direction position with respect to the guiding side-face such that the first finger section and the second finger section interlock with each other when the second casing has been disposed at the facing position.

2. The medium conveyance device of claim 1, wherein:

the position establishing section comprises a circular disk having a central axis running along the conveyance direction, and a rotation support body that supports the circular disk while allowing rotation of the circular disk about the central axis; and a position in the width direction of the guiding side-face is established by a circumferential side face of the circular disk when the second casing has been disposed at the facing position.

3. The medium conveyance device of claim 2, wherein the guiding side-face is configured by inside faces facing each other along the width direction on both sides of a groove formed running along the detachable direction in a face of the one of the first casing or the second casing that faces the other of the first casing or the second casing.

4. The medium conveyance device of claim 3, wherein when the second casing has been disposed at the facing position, respective spacings between the inside faces of the groove that face each other along the width direction and the circumferential side face of the circular disk are each narrower than spacings between mutually adjacent fingers of the first fingers of the first finger section and the respective second fingers of the second finger section.

5. The medium conveyance device of claim 1, wherein when the second casing has been disposed at the facing position, the position establishing section establishes the width direction position with respect to the guiding side-face such that the first finger section and the second finger section interlock with each other while providing a width direction gap therebetween.

6. The medium conveyance device of claim 1, wherein the guiding side-face is provided to one of the first casing or the second casing at a position separated from the first conveyance guide and the second conveyance guide in the width direction.

7. The medium conveyance device of claim 1, wherein the position establishing section is provided to the other of the first casing and the second casing at an detachable direction side of the first fingers of the first conveyance guide or the second fingers of the second conveyance guide.

8. The medium conveyance device of claim 7, wherein the guiding side-face is configured by a width direction side face of a protective finger section that is provided at an detachable direction side of the first conveyance guide or the second conveyance guide on one of the first casing or the second casing and that is formed with a shape corresponding to the first fingers of the first finger section or the second fingers of the second finger section.

9. The medium conveyance device of claim 7, wherein the guiding side-face is configured by a width direction side-face of a finger of the first fingers of the first finger section or a finger of the second fingers of the second finger section on one of the first casing or the second casing.

10. A medium transaction device comprising:

a first casing that is provided with a conveyance section to convey a medium for transaction with a user;

a second casing that internally stores the medium, and that is configured to move in an detachable direction so as to be disposed at a facing position facing the first casing, or so as to be disposed away from the facing position;

a first conveyance guide that is provided to the first casing, and that is configured to guide the medium between the first casing and the second casing as the medium is conveyed along a conveyance direction intersecting the detachable direction when the second casing has been disposed at the facing position;

a second conveyance guide that is provided to the second casing at a location facing the first conveyance guide when the second casing has been disposed at the facing position, and that is configured to guide the medium together with the first conveyance guide;

a first finger section that is disposed at a location on the first conveyance guide facing the second conveyance guide, and that is provided with a plurality of first fingers respectively projecting out toward the second conveyance guide at discrete locations along a width direction intersecting both the detachable direction and the conveyance direction;

a second finger section that is disposed at a location on the second conveyance guide facing the first conveyance guide, and that is provided with a plurality of second fingers respectively projecting out toward the first conveyance guide at discrete locations along the width direction that are complementary locations to the respective first fingers of the first finger section;

a guiding side-face that is provided to one of the first casing or the second casing, and that is formed facing in the width direction and running along the detachable direction; and a position establishing section that is provided to the other of the first casing or the second casing, and that establishes a width direction position with respect to the guiding side-face such that the first finger section and the second finger section interlock with each other when the second casing has been disposed at the facing position.

11. The medium transaction device of claim 10, further comprising a frame that is configured to slide in the detachable direction with respect to the first casing, and that is loaded with a plurality of the second casings in a row along the detachable direction, or from which the plurality of the second casings are removed, wherein:

the first casing is provided with a plurality of the position establishing sections corresponding to the respective second casings loaded into the frame.

12. The medium transaction device of claim 11, wherein:

the guiding side-face is configured by inside faces facing each other along the width direction on both sides of a groove formed running along the detachable direction in a face of the one of the first casing or the second casing that faces the other of the first casing or the second casing;

the plurality of position establishing sections are disposed in a row along the detachable direction so as to align each of the second casings loaded into the frame at the respective facing position; and the grooves are each positioned on a straight line running along the detachable direction when each of the second casings have been loaded into the frame.

* * * * *